US012247388B1

(12) United States Patent
Hedgepeth

(10) Patent No.: US 12,247,388 B1
(45) Date of Patent: Mar. 11, 2025

(54) PURLIN CLIP ASSEMBLY AND SYSTEM

(71) Applicant: Advanced Fastener and Assembly Solutions LLC, Louisburg, NC (US)

(72) Inventor: Alton Craig Hedgepeth, Louisburg, NC (US)

(73) Assignee: Advanced Fastener and Assembly Solutions LLC, Louisburg, NC (US)

( * ) Notice: Subject to any disclaimer, the term of this patent is extended or adjusted under 35 U.S.C. 154(b) by 209 days.

(21) Appl. No.: 17/935,727

(22) Filed: Sep. 27, 2022

Related U.S. Application Data

(63) Continuation-in-part of application No. 17/192,958, filed on Mar. 5, 2021, now Pat. No. 11,466,454, which is a continuation-in-part of application No. 17/087,694, filed on Nov. 3, 2020, now Pat. No. 11,339,564.

(51) Int. Cl.
*E04B 1/24* (2006.01)

(52) U.S. Cl.
CPC .... *E04B 1/2403* (2013.01); *E04B 2001/2415* (2013.01)

(58) Field of Classification Search
CPC ..... F16B 2/245; E04B 2001/2415; E04B 1/2403; E04B 9/18; E04B 9/225; E04B 1/40; E04B 2009/0492; E04D 3/36; E04D 13/1618; E04D 13/1625; E04D 13/1637; E04F 13/005; E04F 13/0814
USPC .... 52/63, 222, 273, 506.05, 506.06, 506.08, 52/702
See application file for complete search history.

(56) References Cited

U.S. PATENT DOCUMENTS 625,427 A * 5/1899 Stewart et al. ..... F16B 9/05 29/897.3
832,133 A * 10/1906 Lanz ..... E04B 1/2612 52/703
1,765,107 A * 6/1930 Snyder ..... B65D 25/02 428/595
3,849,012 A * 11/1974 Krouse ..... E04B 1/2403 403/353
3,874,035 A * 4/1975 Schuplin ..... F16B 2/02 248/228.2
4,333,291 A * 6/1982 Musgrave ..... E04D 3/3602 52/410
4,333,292 A * 6/1982 Musgrave ..... E04D 3/3601 52/410

(Continued)

OTHER PUBLICATIONS

Three page Information Disclosure Statement filed in co-pending U.S. Appl. No. 17/192,958 with the USPTO filed Jun. 11, 2021, citing six US references and twenty foreign references, all foreign references are being submitted herewith.

(Continued)

*Primary Examiner* — Paola Agudelo
*Assistant Examiner* — Adam G Barlow
(74) *Attorney, Agent, or Firm* — Tuggle Duggins P.A.; Reinier R. Smit; Blake P. Hurt

(57) ABSTRACT

A weight-bearing system for hanging items from the roof structure of a metal building is disclosed. The system includes a purlin with at least one flange, a span aperture in the vertical span of the purlin, a clip that attaches to the purlin using the span aperture, and a fastener on the clip for transferring weight applied to the fastener to the clip and to the vertical span of said purlin.

20 Claims, 22 Drawing Sheets

(56) References Cited

U.S. PATENT DOCUMENTS 4,391,075 A * 7/1983 Musgrave ..... E04D 13/1637 52/404.1
5,535,560 A * 7/1996 Fligg ..... E04D 13/1637 52/407.3
5,581,966 A * 12/1996 Fligg ..... E04B 9/303 52/404.3
5,667,181 A * 9/1997 van Leeuwen ..... E04B 9/18 52/39
6,086,032 A * 7/2000 van Leeuwen ..... E04B 9/18 248/228.1
6,240,682 B1 * 6/2001 James ..... E04B 7/024 52/90.2
6,799,407 B2 * 10/2004 Saldana ..... E04B 1/2403 52/715
7,014,383 B2 * 3/2006 Schmid ..... E04B 1/2604 403/231
7,913,472 B2 * 3/2011 Troth ..... E04B 7/063 52/696
8,225,575 B2 * 7/2012 Gadd ..... E04B 1/2612 52/715
8,234,826 B1 * 8/2012 Proffitt, Jr. ..... E02D 27/00 52/712
8,769,887 B2 * 7/2014 Proffitt, Jr. ..... E04B 2/58 52/696
2006/0096234 A1 * 5/2006 Miller ..... E04D 3/361 52/712
2007/0119108 A1 * 5/2007 Downard ..... E04B 1/2604 52/301
2009/0211177 A1 * 8/2009 Grafton ..... E04B 7/02 248/237
2014/0338282 A1 * 11/2014 Sidhu ..... E04C 3/14 52/702

OTHER PUBLICATIONS

Two page Information disclosure statement filed in co-pending U.S. Appl. No. 17/192,958 with the USPTO filed Nov. 23, 2021, citing thirty-five US references.

Three page Notice of References in co-pending U.S. Appl. No. 17/192,958 from the Notice of Allowance dated Jun. 8, 2022.

* cited by examiner

PURLIN CLIP ASSEMBLY AND SYSTEM

This is a continuation-in-part of and claims benefits under pending prior application Ser. No. 17/192,958 filed 5 Mar. 2021 which is a continuation-in-part of prior application Ser. No. 17/087,694 filed 3 Nov. 2020, now U.S. Pat. No. 11,339,564 each of which are incorporated by reference in their entireties herein.

FIELD OF THE INVENTION

The disclosure relates to building structures and is particularly advantageous in prefabricated metal buildings.

DESCRIPTION OF THE PRIOR ART AND OBJECTIVES OF THE INVENTION

As used herein, the term "metal building," typically refers to a steel structure with a steel frame (although sometimes a wood frame) that is easier and faster to build then some other types of construction. Metal buildings also can require less upkeep than buildings made using other materials. Examples include barns, garages, carports, storage buildings and the like. Metal buildings are also used commercially for stores, churches, and schools. Others are used in the agricultural context such as animal barns and crop storage.

Prefabricated metal buildings can be assembled more quickly than conventional structures and often at lower cost. Their footprint can be modified quickly for ease of expansion and flexibility of use. Generally speaking, a steel building can have a longer lifetime than a similar structure made of wood, and the lower fire hazard can make metal buildings less expensive to insure.

The structural elements of many metal buildings include vertical posts to which purlins connect to form the framework for the roof. As used herein, a purlin is a longitudinal member in a roof frame for supporting common rafters between the plate and the ridge. In certain metal buildings the purlins are roughly Z-shaped girders formed of a web or span that orients vertically in construction and two flanges which extend at 90° from the web in opposite directions from one another.

In many circumstances (including some required by building codes) insulation is then placed into the roof structure following which the purlins are covered with a sheet, typically a synthetic fabric material. Thus, from the perspective inside the building, the sheet forms the ceiling and hides the purlins and the other parts of the roof structure Because of the various uses for metal buildings, however, a need often exists to hang various items from the ceiling (e.g., loudspeakers, lighting, HVAC components), which in turn means hanging those items from the roof structure behind the roof fabric. In one conventional method, this is typically done by puncturing the fabric ceiling at the intended location, and then driving (e.g.) self-tapping screws into the roof structure. This is generally unsatisfactory for several reasons including the exploratory nature of puncturing the ceiling fabric and the fact that many users take the shortcut of hanging a clip from the flange of the purlin, with the flange being the weakest point of the roof structure. In some cases, hanging items from a purlin flange violates building codes.

As another problem, the desired or necessary amount of insulation required in any given circumstance (e.g., local climate; expected purpose for the building) can make a current pre-engineered metal roof structure unattractive or simply inappropriate. In particular, because either glass wool or foam board insulation provides only about R-3 to R-5 per inch of thickness, the amount of insulation required to reach (e.g.) R-60 may be either unworkable or disadvantageous in current pre-engineered metal structures.

Thus a need exists for a more efficient method of using a roof structure under a fabric ceiling, for avoiding excessive weight on purlin flanges, for positioning hanging items from stronger portions of the roof structure, and for avoiding unnecessary or excess openings in a fabric ceiling.

SUMMARY OF THE INVENTION

In one aspect the disclosure is a weight-bearing system for hanging items from the roof structure of a metal building. The system includes a purlin with at least one flange, a span aperture in the vertical span of the purlin, a clip that attaches to the purlin using the span aperture, and a fastener on the clip for transferring weight applied to the fastener to the clip and to the vertical span of said purlin.

In another aspect the disclosure is a method for hanging items inside of metal buildings. The method includes the steps of positioning a plurality of purlin-supported fasteners against the roof side of the fabric ceiling of a metal building in a manner that urges the fasteners directly into contact with the fabrics. Thereafter, and starting from a position inside the building and below the fabric ceiling, locating at least one of the fasteners underneath the fabric ceiling that are contacting the fabric and hanging a weighted item from the at least one located fastener.

In another aspect the disclosure is a roof structure that includes a plurality of struts supported by vertical posts, a plurality of purlins supported by the struts, a fabric ceiling under the purlins, and a plurality of clips attached to the purlins in which each clip includes a fastener that bears against said fabric ceiling to flex the fabric ceiling at the point of the fastener.

In yet another aspect the disclosure is an improved system for weight-bearing fixtures in metal buildings. In this aspect the system includes a purlin and a clip attached to the purlin. The purlin includes a vertical span, at least one flange at an oblique angle to the span, and a span aperture defined by the purlin and positioned midway along the vertical span. The clip includes an outer frame formed of an outer base, an outer column extending vertically from the outer base, and an outer finger protruding from the outer column at an oblique angle to the outer column. The clip further includes an inner frame inside of the outer frame and formed of an inner base, an inner column extending vertically from the inner base, and an inner finger protruding from the inner column at an oblique angle to the inner column. The inner frame and the outer frame are attached to one another in a manner that permits the inner frame and the outer frame to move with respect to one another a defined distance parallel to the axis of the respective columns, and with the fingers of the inner frame and the outer frame being positioned into and through the span aperture in the purlin.

In yet another aspect the disclosure is a clip for supporting weight from the roof of a metal building. The clip includes an outer frame formed of an outer base, an outer column extending vertically from the base, and an outer finger protruding from the outer column at an oblique angle to the outer column. The clip also includes an inner frame inside of the outer frame and formed of an inner base, an inner column extending vertically from the inner base, and an inner finger protruding from the column at an oblique angle to the inner column. The inner frame and the outer frame are attached to one another in a manner that permits the inner frame and the outer frame to move with respect to one another a defined distance parallel to the axis of the respective columns.

In yet another aspect the disclosure is a clip for supporting weight from the roof of a metal building, in which the clip includes a column, a clip flange on the column and oriented perpendicular to the column, a column base, a fastener depending from the bottom of the column base, and a base shelf extending from the base in a direction perpendicular to both the column and the clip flange.

The foregoing and other objects and advantages of the disclosure and the manner in which the same are accomplished will become clearer based on the following detailed description taken in conjunction with the accompanying drawings.

DETAILED DESCRIPTION OF THE PREFERRED EMBODIMENT AND OPERATION OF THE INVENTION

Figure 1:
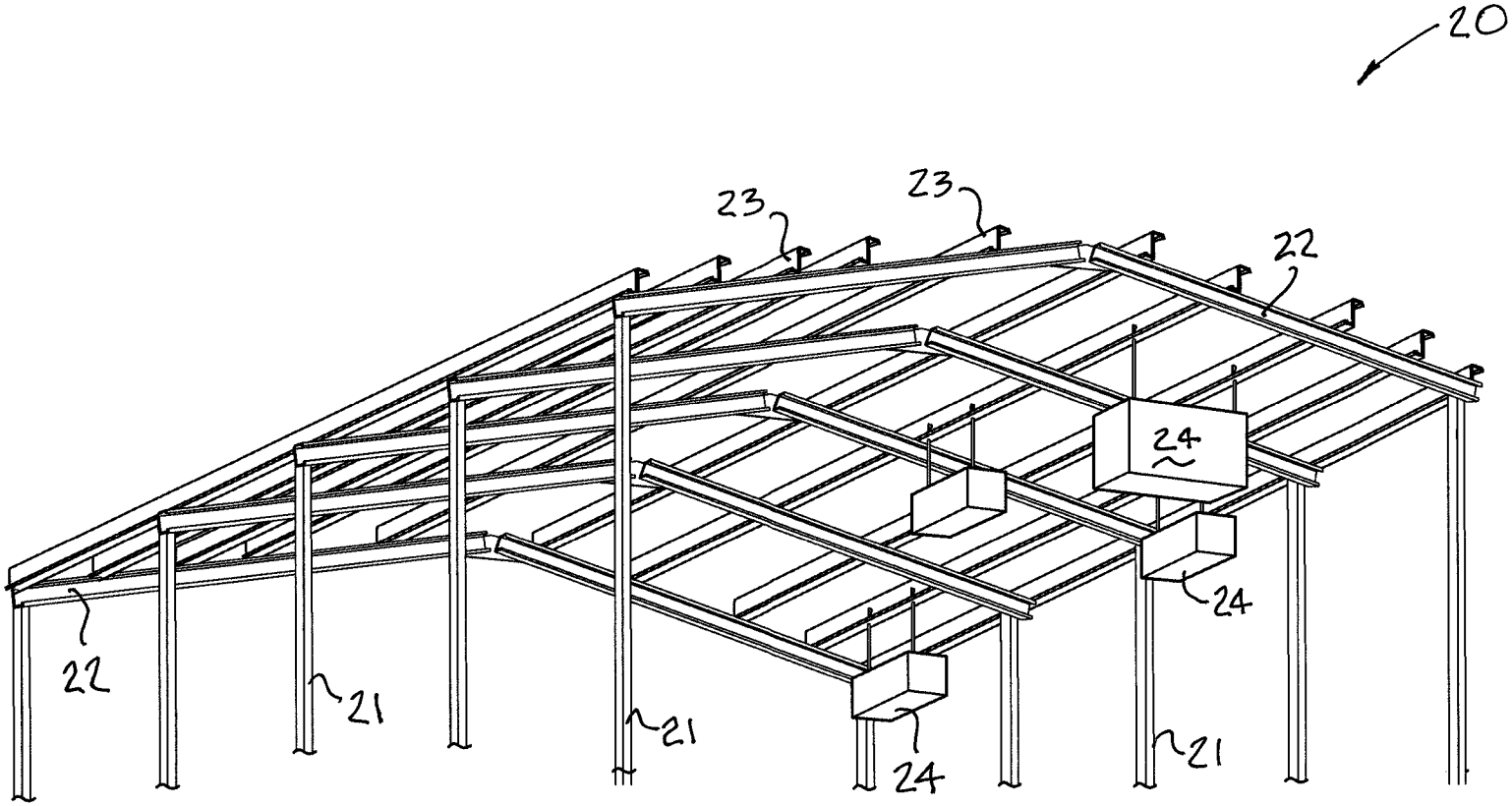
FIG. 1 is a partial perspective view of an exemplary framework for a metal building.

Various exemplary embodiments of the present disclosure are described below. Use of the term "exemplary" means illustrative or by way of example only, and any reference herein to "the disclosure" is not intended to restrict or limit the disclosure to exact features or step of any one or more of the exemplary embodiments disclosed in the present specification. References to "exemplary embodiment", "one embodiment", "an embodiment", "various embodiments", and the like may indicate that the embodiment(s) of the disclosure so described may include a particular feature, structure, or characteristic, but not every embodiment necessarily incudes the particular feature, structure, or characteristic. Further, repeated use of the phrase "in one embodiment", "in an exemplary embodiment", or "in an alternative embodiment" do not necessarily refer to the same embodiment, although they may.

It is also noted that terms like "preferably", "commonly", and "typically" are not utilized herein to limit the scope of the disclosure or to imply that certain features are critical, essential, or even important to the structure or function of the disclosure. Rather, these terms are merely intended to highlight alternative or additional features that may or may not be utilized in a particular embodiment of the present disclosure.

The present disclosure is described more fully hereinafter with reference to the accompanying figures, in which one or more exemplary embodiments of the disclosure are shown. Like numbers used herein refer to like elements throughout. The disclosure may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limited as to the scope of the disclosure, and any and all equivalents thereof. Moreover, many embodiments such as adaptations, variations, modifications, and equivalent arrangements will be implicitly disclosed by the embodiments described herein and fall within the scope of the instant disclosure.

Although specific terms are employed herein, they are used in a generic and descriptive sense only and not for the purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. Where only one item is intended, the terms "one and only one", "single", or similar language is used. When used herein to join a list of items, the term "or" denotes at least one of the items but does not exclude a plurality of items of the list.

For exemplary methods or processes of the disclosure, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present disclosure.

Additionally, any references to advantages, benefits, unexpected results, or operability of the present disclosure are not intended as an affirmation that the disclosure has previously been reduced to practice or that any testing has been performed. Likewise, unless stated otherwise, use of verbs in the past tense (present perfect or preterit) is not intended to indicate or imply that the disclosure has previously been reduced to practice or that any testing has been performed.

FIG. 1 illustrates in general upper portions of a roof structure 20. The structure is formed from a plurality of vertical posts 21, a plurality of struts 22 supported by the vertical posts 21, and which in turn support a plurality of purlins 23. As set forth in the background, because of the multitude of uses and flexibility provided by metal buildings of this type, FIG. 1 also illustrates several appliances 24 supported by the purlins 23.

Figure 2:
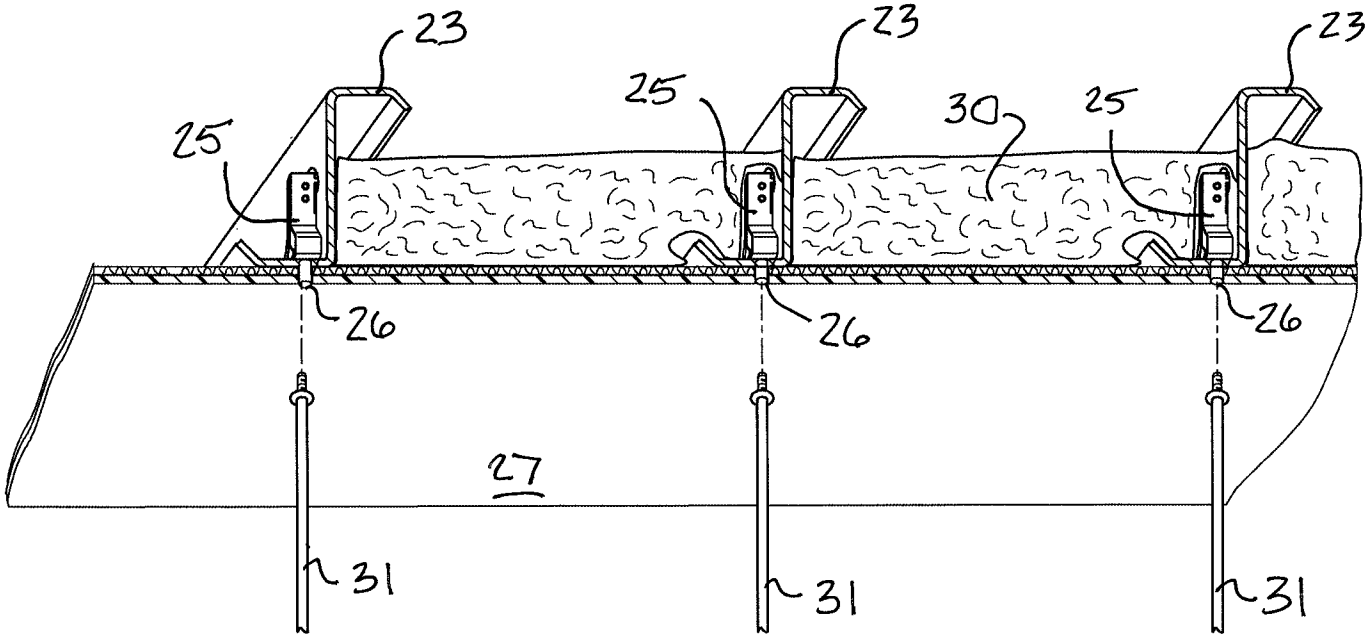
FIG. 2 is a perspective view of the clip and purlin of present disclosure in an environmental setting.

FIG. 2 is a cutaway view of a roof structure in a metal building that incorporates a plurality of clips 25 that are attached to respective purlins 23. Each clip includes a fastener 26 as part of the clip 25 and in which (e.g. FIG. 3) the fastener 26 depends from the clip 25 so that the fastener 26 bears against the fabric ceiling 27 to flex or tent the ceiling fabric at the position of the fastener 26. FIG. 2 also illustrates some insulation 30 which is almost always present in any metal building that is expected to be used for a public purpose (auditorium, school, gymnasium, etc.) both to add comfort to the users and make any use of heating, ventilation and air conditioning systems more efficient.

As is generally well understood in the art, the fabric ceiling 27 is typically held in place by longitudinal banding parallel to the purlins 23 combined with transverse banding perpendicular to the purlins. In general, the spacing and position of the longitudinal banding will depend on the spacing between purlins, and the transverse banding will be positioned to create generally equal segments and with at least some banding close to any roof edges.

As will be seen in several of the illustrations, the fasteners 26 are illustrated as a T-nut of the type that has interior female threads. Based on this, FIG. 2 illustrates a plurality of hanger bolts 31 that can engage the fasteners 26 and from which appliances 24 such as those illustrated in FIG. 1 can be suspended.

Figure 3:
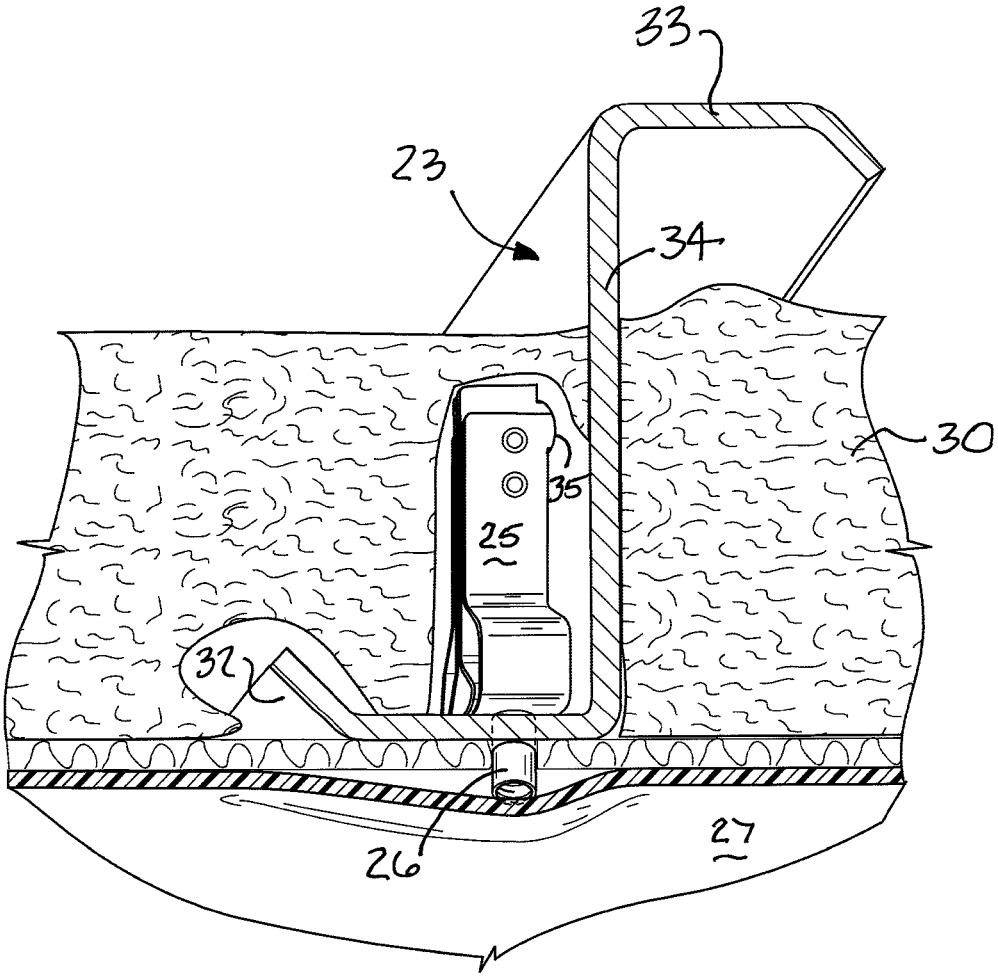
FIG. 3 is an enlarged cutaway view of the clip, a purlin, the fastener and the fastener bearing against the fabric ceiling.

FIG. 3 illustrates aspects of the disclosure in greater detail. FIG. 3 illustrates a purlin 23 which includes at least one flange 32 positioned near the ceiling fabric 27, and a second flange 33 at the top of the purlin, with a span 34 between the flanges 32 and 33. A span aperture 35 (illustrated in larger scale in FIG. 7), is in the vertical span 34 of the purlin. A flange aperture 36 (FIG. 7) is in the flange 32 at the ceiling. The clip 25 attaches to the purlin 23 using both of the apertures 35 and 36. The fastener 26 depends from the clip 25 and serves to transfer weight applied to the fastener 26 to the clip 25 and in turn to the (strong) vertical span of the purlin.

As FIG. 3 makes evident, and one of the disadvantages of the prior art, if the weight of a hanging object were supported only by the flange 32, the weight-bearing capacity would be greatly reduced as compared to the combination of the clip attached to the vertical span 34 of the purlin 23.

FIG. 3 also illustrates that the fastener 26 depends through the flange aperture 36 in the purlin. In the illustrated embodiment the fastener is a T-nut 26 and (as just referenced with respect to FIG. 2), threaded bolts 31 can be inserted into the T-nut 26 and an appliance 24 can be suspended from the threaded bolt 31.

As will be further described with respect to (e.g.) FIGS. 12-19 the purlin 23 can include a second span aperture 37 in the span of the purlin 23 and with the clip 25 attached to both of the span apertures 35 and 37 as well as to the flange aperture 36.

As best illustrated in FIGS. 4-11, the clip 25 includes a plurality of fingers (to be described further herein) for engaging each of the span apertures 35 and 37.

FIG. 3 also illustrates an important aspect and advantage of using the disclosure. The plurality of purlin 23-supported fasteners 26 can be positioned against the roof side of the fabric ceiling 27 of the roof structure 20 in a manner that urges the fasteners 26 directly into contact with the fabric 27. FIG. 3 shows this as the tent or flex in the fabric 27 at the T-nut 26. With the fabric 27 bearing directly against the fasteners 26, and starting from a position inside the metal building and below the fabric ceiling 27, the fasteners can be easily located underneath the fabric ceiling at the positions where they contact the fabric 27, so that a weighted item can be suspended from the located fasteners 26 without the need to explore or open the fabric to find items that are otherwise hidden from view.

FIGS. 4 through 11 illustrate a first embodiment of the clip 25 in more detail. The clip 25 is illustrated in the form of an outer frame 40 and an inner frame 41 with the inner frame 41 inside of the outer frame 14. The outer frame includes an outer base 42 which in the illustrated embodiment is not a separate part, but generally the partially five-sided structure shown in the drawings. An outer column 43 extends vertically (the orientation refers to the position in use) from the outer base and terminates at an outer finger 44 that protrudes or extends from the top of the outer column 43 at an oblique angle (90° as illustrated) to the outer column.

In the illustrated embodiment the outer frame 40 has two parallel columns 43 and two of the outer fingers 44. A pair of rivets 45 (at least one extends through the outer column 43.

The inner frame 41 is inside of the outer frame 40 and is formed of and inner frame base 46 which again represents a portion of the inner frame 41 rather than a separate element and is illustrated in a generally triangular shape. An inner column 47 (two are illustrated) extends vertically from the inner frame base 46 and likewise terminates in an inner finger 50 (two are shown) at an oblique angle (also illustrated as) 90° from the inner column. The inner frame 41 and the outer frame 40 are attached to one another in a manner that permits the inner frame 41 and outer frame 40 to move with respect to one another a defined distance parallel to the axis of the respective outer 43 and inner 47 columns. As best illustrated in FIGS. 8-11 the fingers 44 and 50 of the inner and outer frames 41, 40 are positioned into and through the span aperture 35 in the span 34 of the purlin 23.

Figure 6:
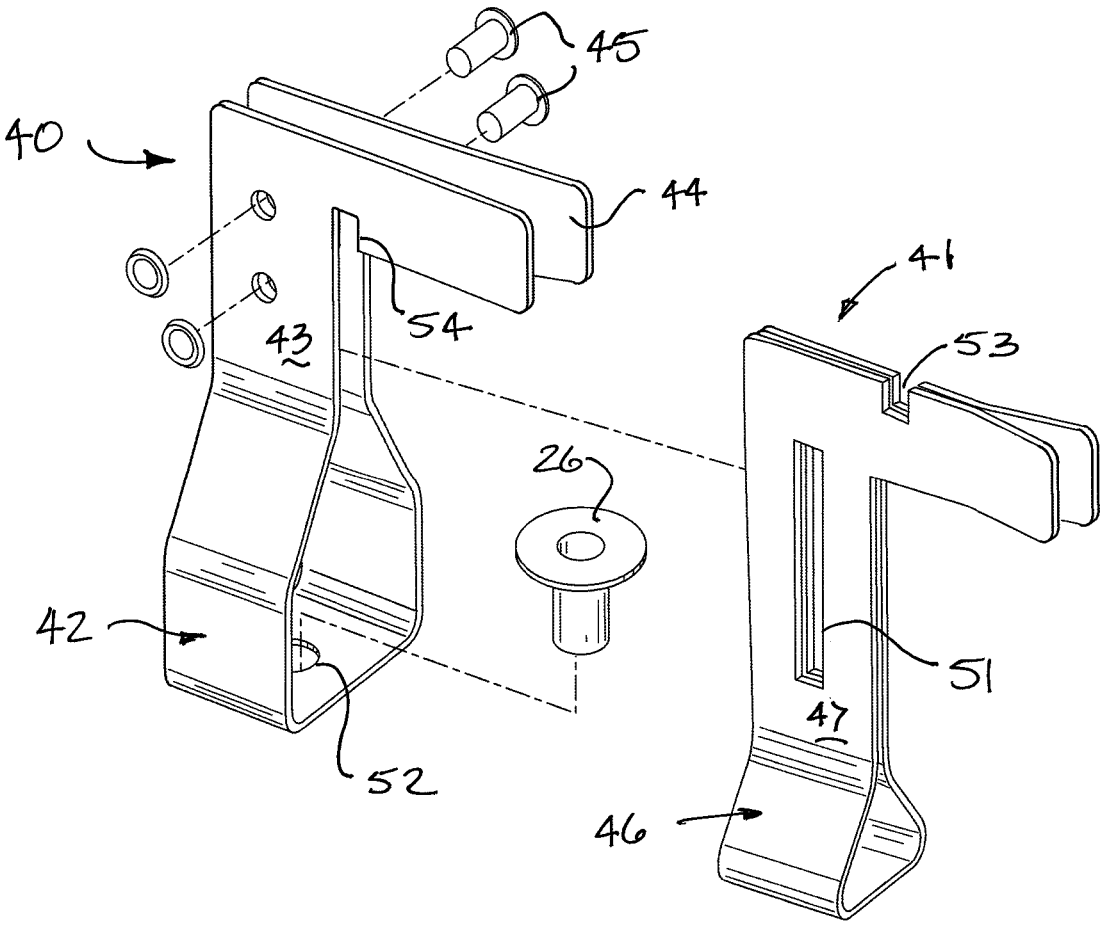
FIG. 6 is an exploded view of one embodiment of a clip according to the disclosure.

FIG. 6 is an exploded view of the clip 25 that helps illustrate the structure and function of the clip 25. In particular, FIG. 6 illustrates a rivet slot 51 in the inner column 47 that together with the rivets 45 permits the movement of the inner frame 41 and the outer frame 40 with respect to one another.

FIG. 6 also illustrates the fastener 26, again in the form of a T-nut which is positioned in a fastener opening 52 in the outer base 42.

Figure 7:
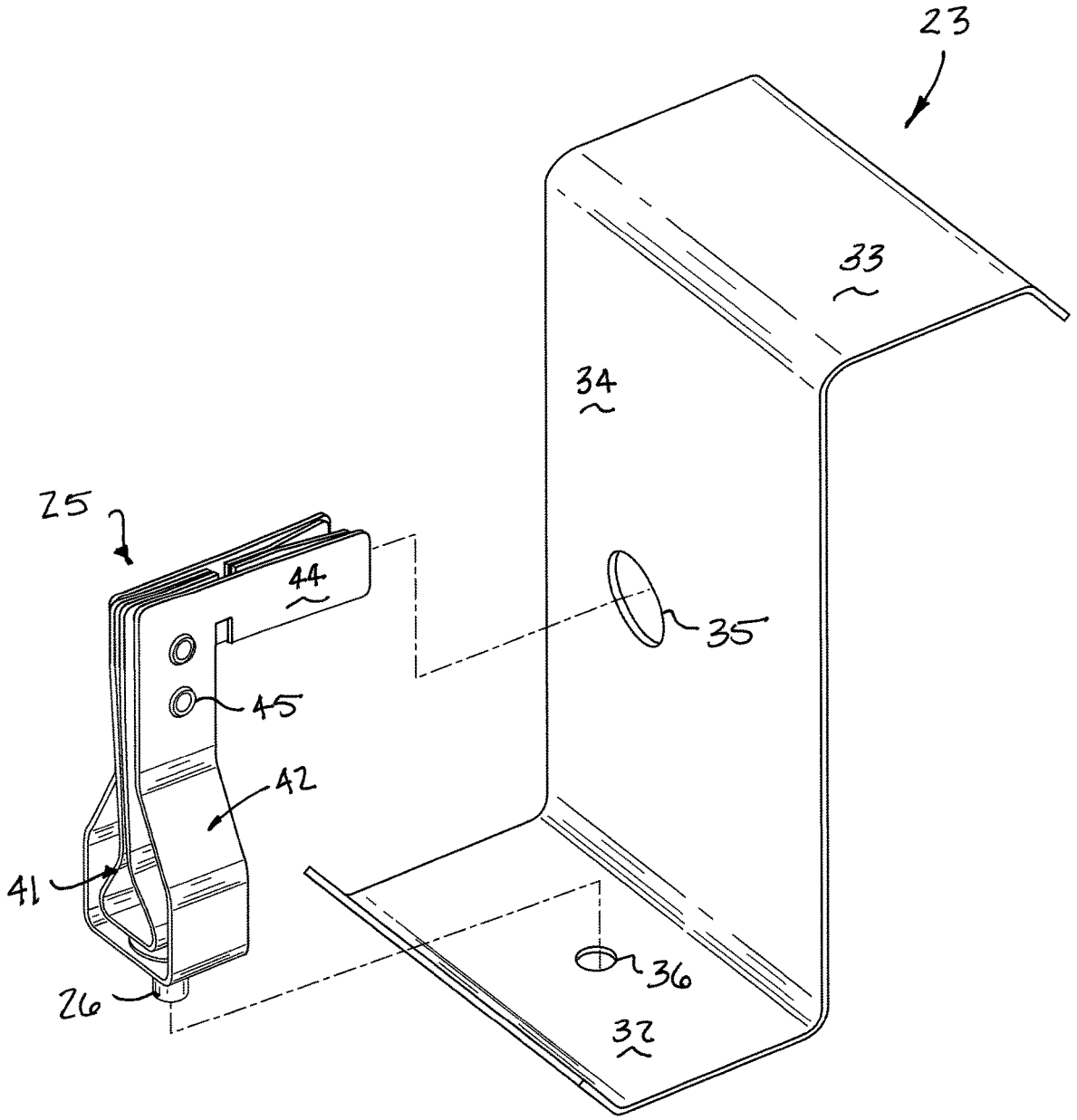
FIG. 7 is a perspective exploded view illustrating a segment of the purlin and a clip.

FIG. 7 is an exploded view of the clip 25 and the purlin 23. The purlin includes the flanges 32 and 33, the span 34, and the span aperture 35. FIG. 7 illustrates that when the fingers 44 and 50 are positioned into and through the span aperture 35, the fastener 26 that depends from the outer base 42 projects through the flange aperture 36.

Figure 8:
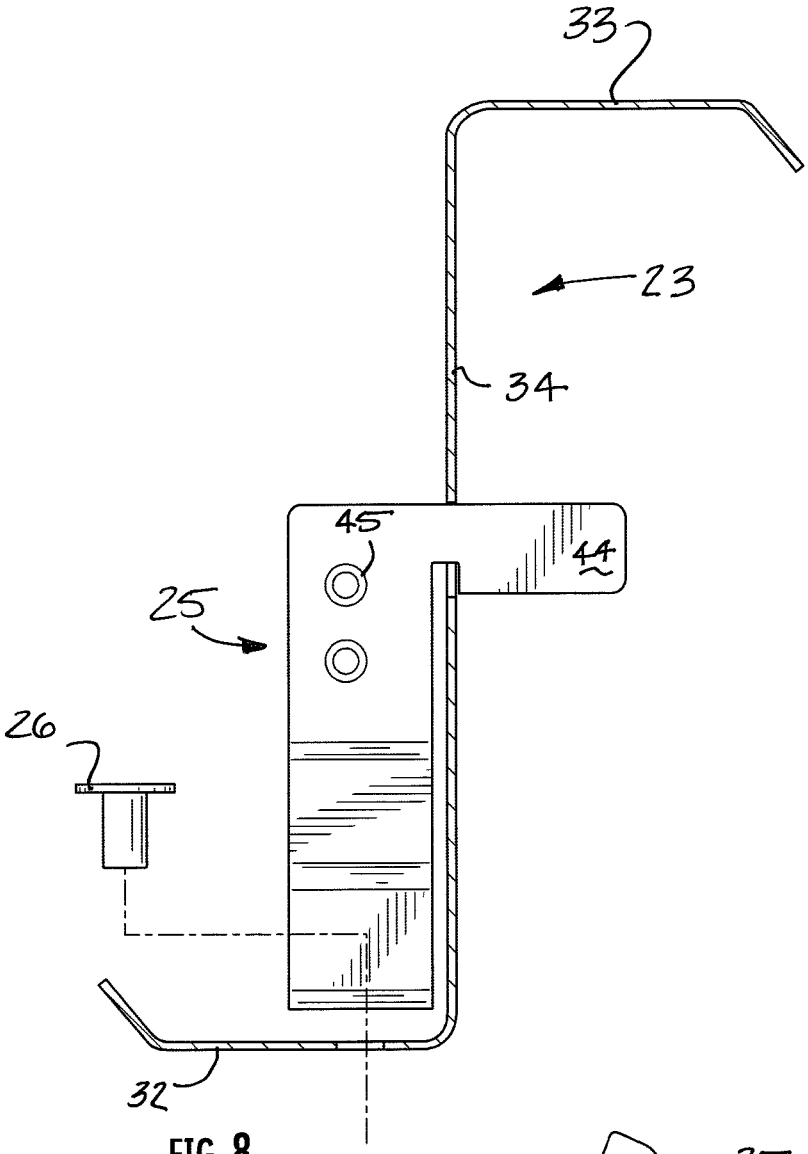
FIG. 8 is a side elevational view of the clip as inserted into the purlin.
Figure 9:
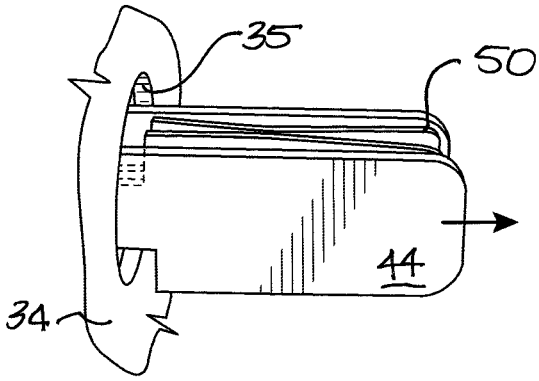
FIG. 9 is a perspective view of a portion of the clip that passes through the purlin.

FIGS. 8 and 9 illustrate aspects of the relationship between the clip 25 and the purlin 23 when the fingers 44 and 50 have been inserted through the span aperture 35. FIGS. 8 and 9 illustrate a position referred to as "closed" meaning that the inner and outer frames are in a position that minimizes the axial length of the clip 25 and allows the fingers 44 and 50 be inserted through the span aperture 35.

FIG. 9 is an enlarged view of the fingers 44 and 50 extending through the span aperture 35 and further illustrates that the fingers can include a flexed portion that provides a spring force in which the inner fingers 50 push against the outer fingers 44.

Figure 10:
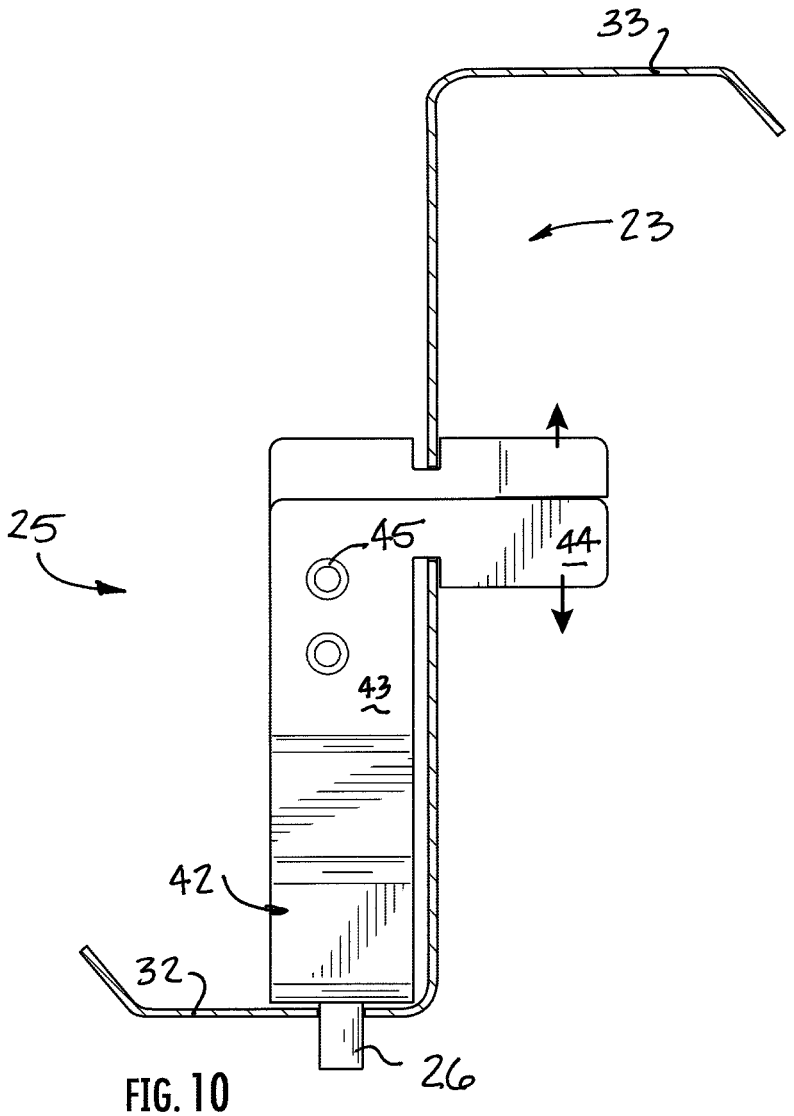
FIG. 10 is a side elevational view similar to FIG. 7 but showing the clip in the open orientation in which it grips the purlin.
Figure 11:
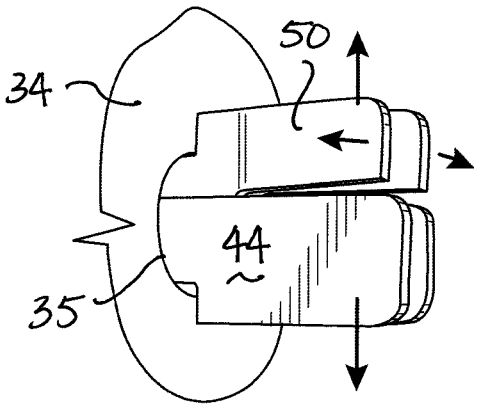
FIG. 11 is a view similar to FIG. 8 but showing the open position of FIG. 10.

FIGS. 10 and 11 are very similar to FIGS. 8 and 9, but show the clip 25 in an open position with respect to the purlin 23 and particularly with respect to the span aperture 35. To change from the orientation of FIGS. 8 and 9to that of FIGS. 10 and 11, the user, after having inserted the fingers 44, 50 can use the base portions 42 and 46 to physically slide the inner frame upwardly (again in the orientation of use) to engage opposite portions of the circumference of the span aperture 35. In the illustrated embodiment inner finger notches 53 and outer finger notches 54 engage the span aperture 35 to help fix the clip 25 in position with respect to the purlin 23. In this position the fastener 26 extends through the flange aperture 36 to form a position over which the fabric ceiling 27 can flex for the purpose described (locating the fastener 26) with respect to FIG. 3.

Figure 12:
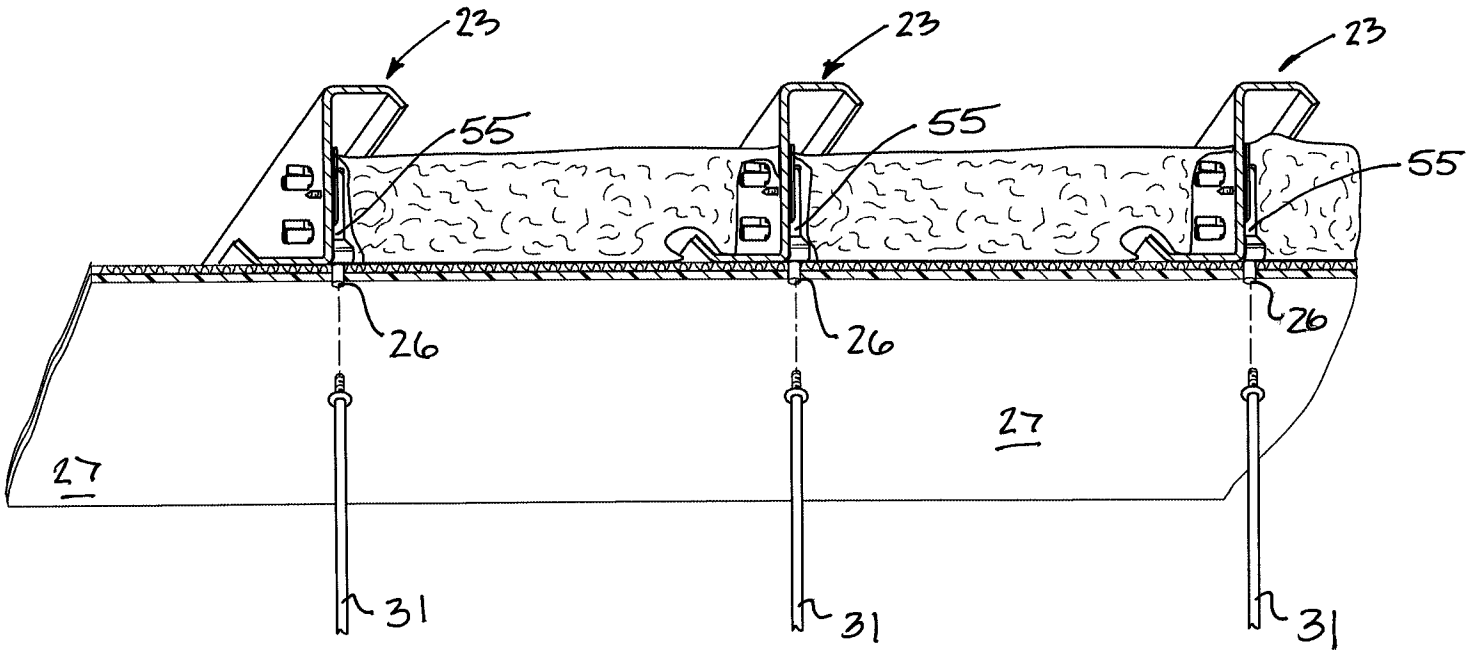
FIG. 12 is a perspective view of a second embodiment of the clip and purlin of present disclosure in an environmental setting.

FIG. 12 is a cutaway perspective view analogous to FIG. 2 but showing the use of a second embodiment of the clip broadly designated at 55. As FIG. 12 illustrates, the second embodiment clip 55 can be used independently of the presence of a flange aperture 36, although it will be understood that if a flange aperture is present, the second embodiment of the clip can be used with or without the flange aperture 36. Thus, in FIG. 12 the fastener 26 simply depends toward the ceiling fabric 27 without passing through any flange aperture 36. This gives a flexible option for reducing the number of flange openings, either partially or completely, in the purlin 23.

Figure 4:
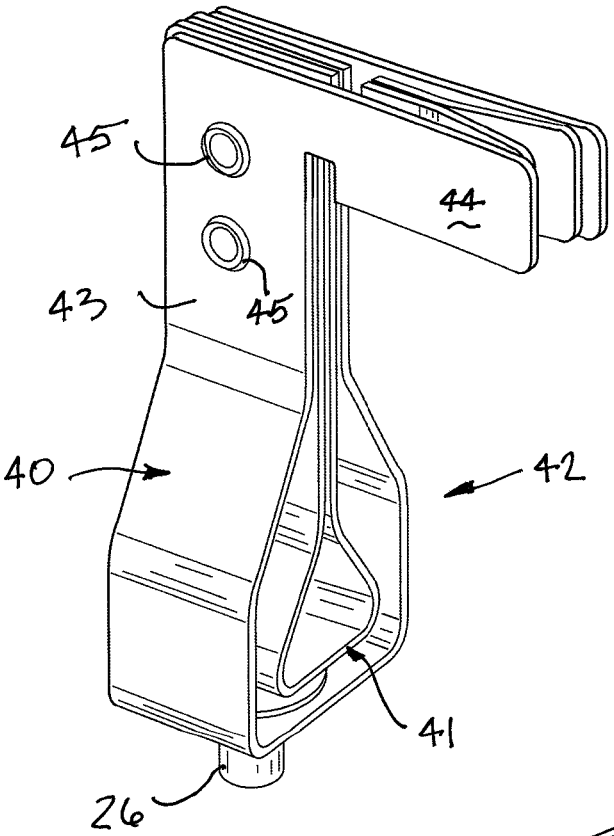
FIG. 4 is a perspective view of one embodiment of a clip according to the disclosure.
Figure 5:
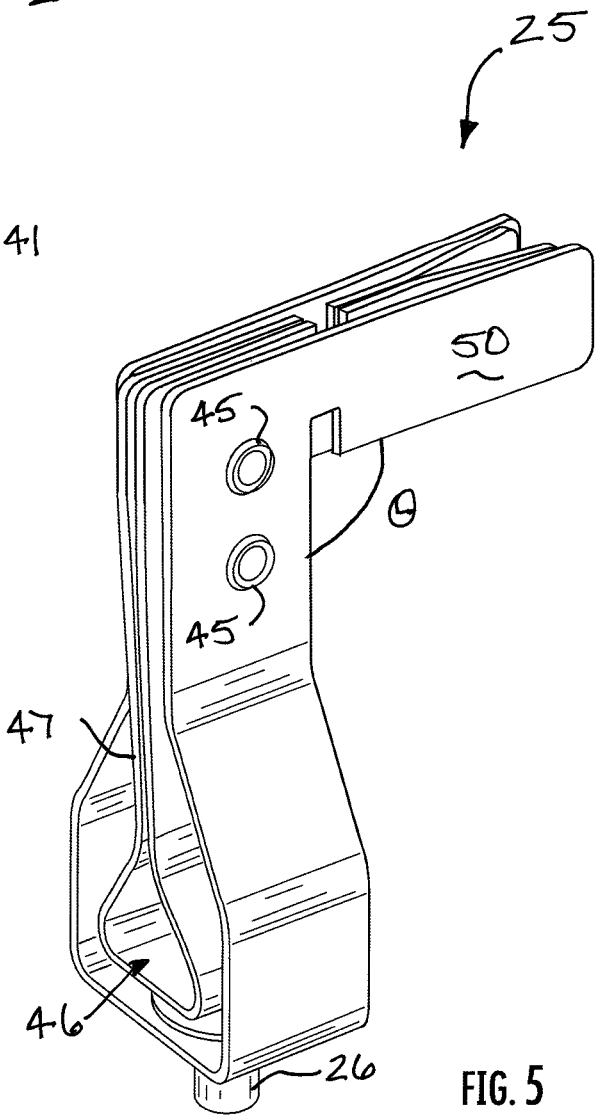
FIG. 5 is an opposite perspective view of the embodiment of a clip as shown in FIG. 4.
Figure 13:
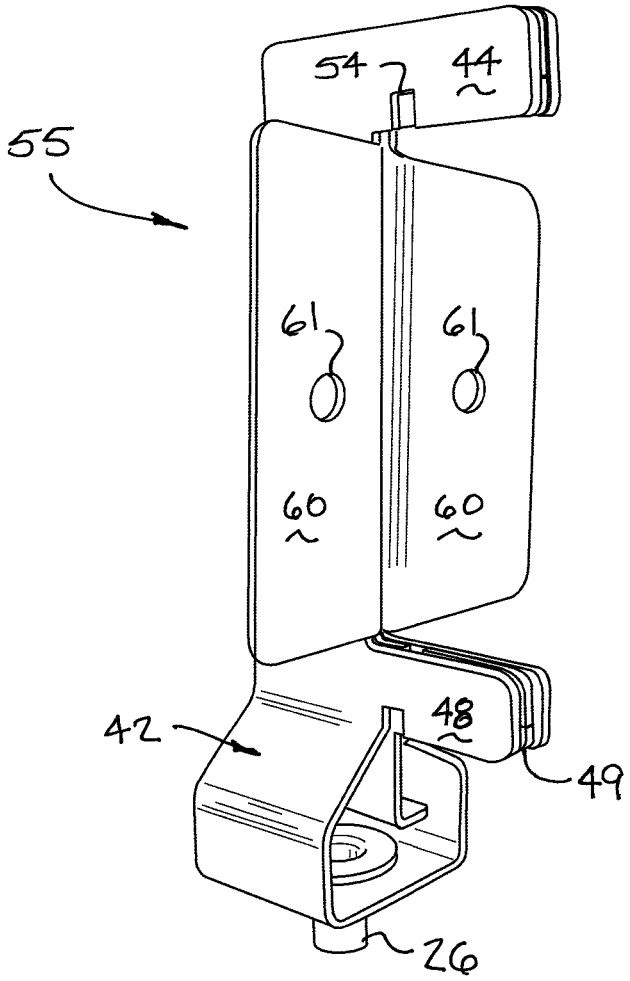
FIG. 13 is a perspective view of a second embodiment of a clip according to the disclosure in the closed position.
Figure 14:
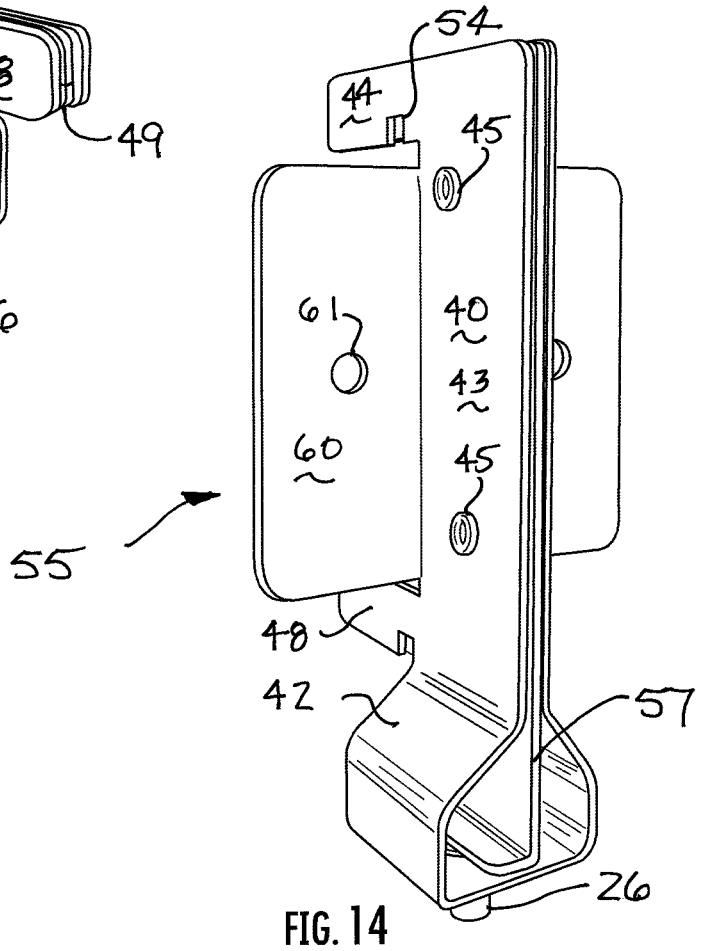
FIG. 14 is a perspective view of the second embodiment of a clip as shown in FIG. 13 in the closed position.
Figure 18:
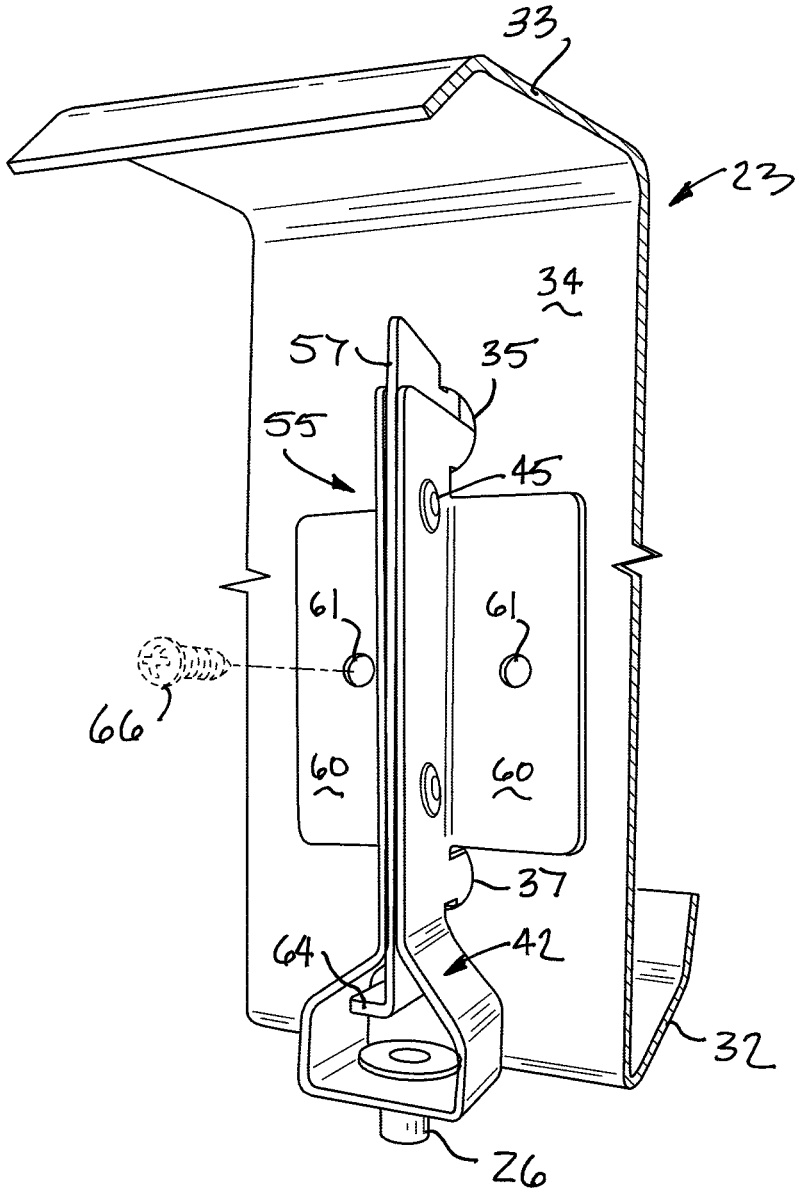
FIG. 18 is a respective perspective view of the second embodiment of the clip inserted into the web portion of the purlin.

FIGS. 13 and 14 are analogous to FIGS. 4 and 5 in showing the second embodiment of the clip in a "closed" position. The second embodiment is formed of a single inner column 57 in an outer frame 40 substantially the same as the outer frame in the first embodiment, and with at least one (and two are shown) clip flanges 60 extending perpendicularly from the column 43 of the outer frame 40. Each clip flange 60 has a clip flange hole 61 which can be used as one method of fastening the clip flanges 60 to the span 34 of a purlin 23. A second outer finger 48 is position near the outer base 42 and defines a spacing between the outer fingers 44 and 48 that substantially matches the spacing of the two span apertures 35, 37 (FIG. 18). A second inner finger 49 is likewise positioned near the inner frame base 46 or any equivalent position on the single inner column 57. The spacing of the inner fingers likewise matches the position of the span apertures 35, 37.

Figure 15:
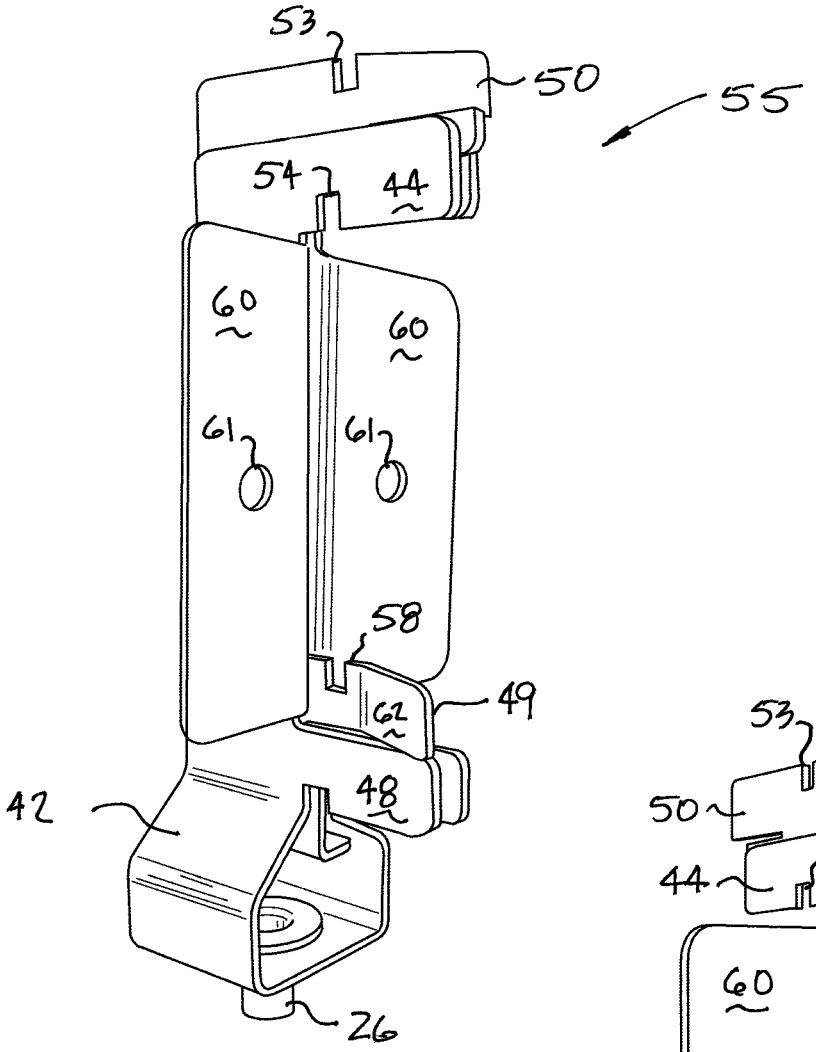
FIG. 15 is a perspective view of the clip of FIG. 13 in the opened position.
Figure 16:
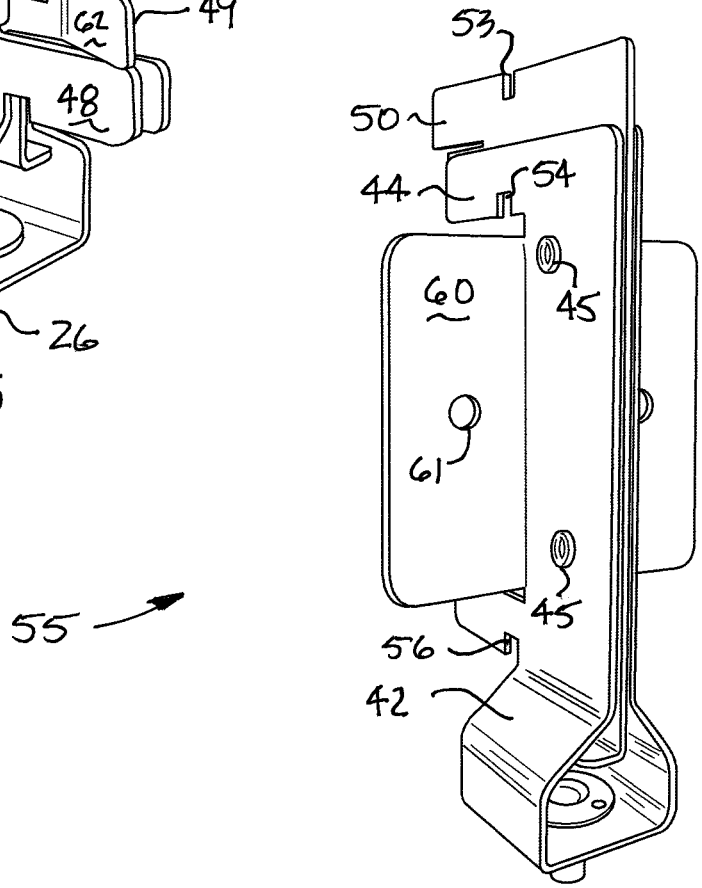
FIG. 16 is a perspective view of the clip of FIG. 14 in the opened position.

FIGS. 15 and 16 show the second embodiment of the clip 55 in the opened position including the inner finger notches 53 and the outer finger notches 54, each of which action the same manner as described with respect to the first embodiment. FIGS. 15 and 16 also illustrates the flexed portions 62 on the inner finger which can provide a spring force in the same manner as in the first embodiment 25 of the clip. FIGS. 15 and 16 also help illustrate the respective second outer finger notches 56 and the second inner finger notches 58.

Figure 17:
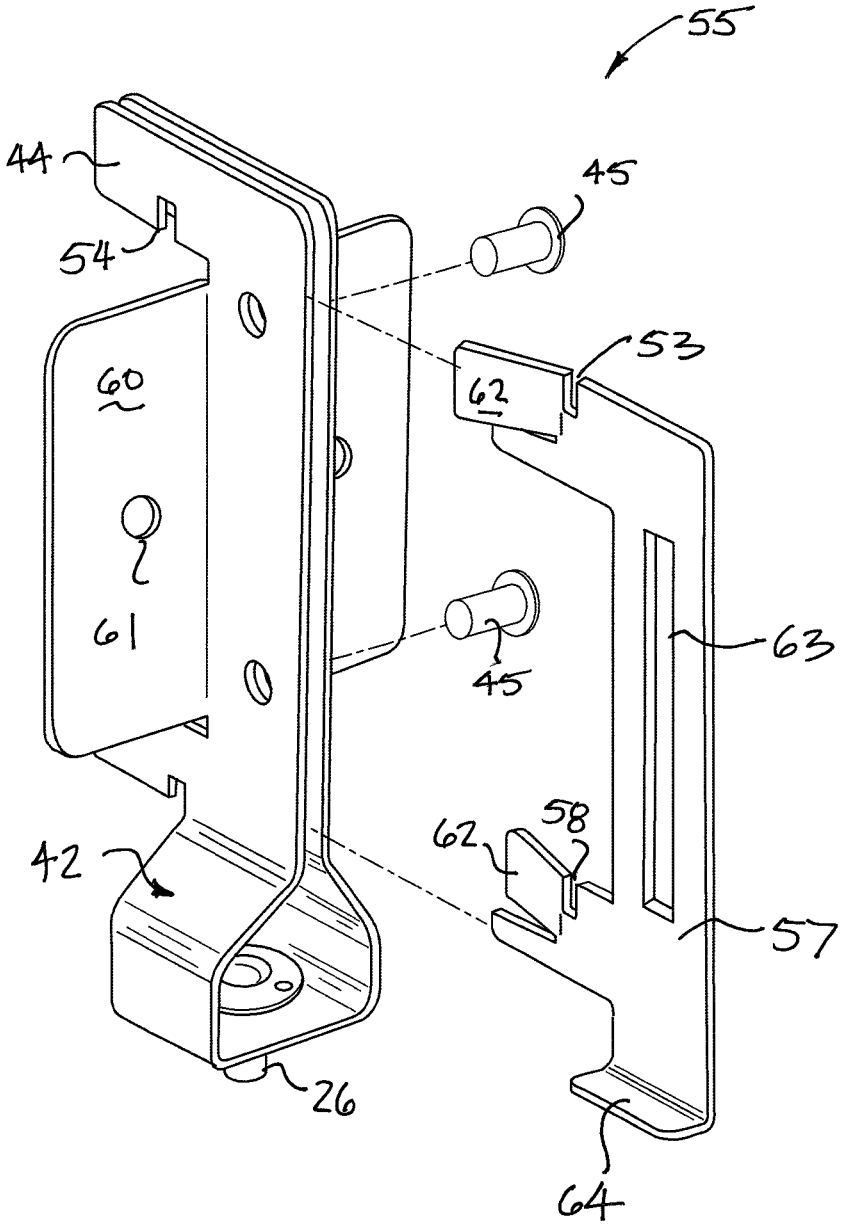
FIG. 17 is a partially exploded view of the second embodiment of the clip.

FIG. 17 is analogous to FIG. 6 and shows the second embodiment of the clip 55 in exploded fashion. In addition to illustrating the single inner column 57, FIG. 17 also shows an extended rivet slot 63 in the single inner column with the extended rivet slot 63 cooperating with the rivets 45 in the same manner as in the first embodiment to allow the movement of the single inner column 57 and the outer frame 40 with respect to one another. FIG. 17 also helps illustrate that the single inner column 57 includes a column tab 64 that gives a user a place of purchase to move the single inner column 57 with respect to the outer frame 40.

Figure 19:
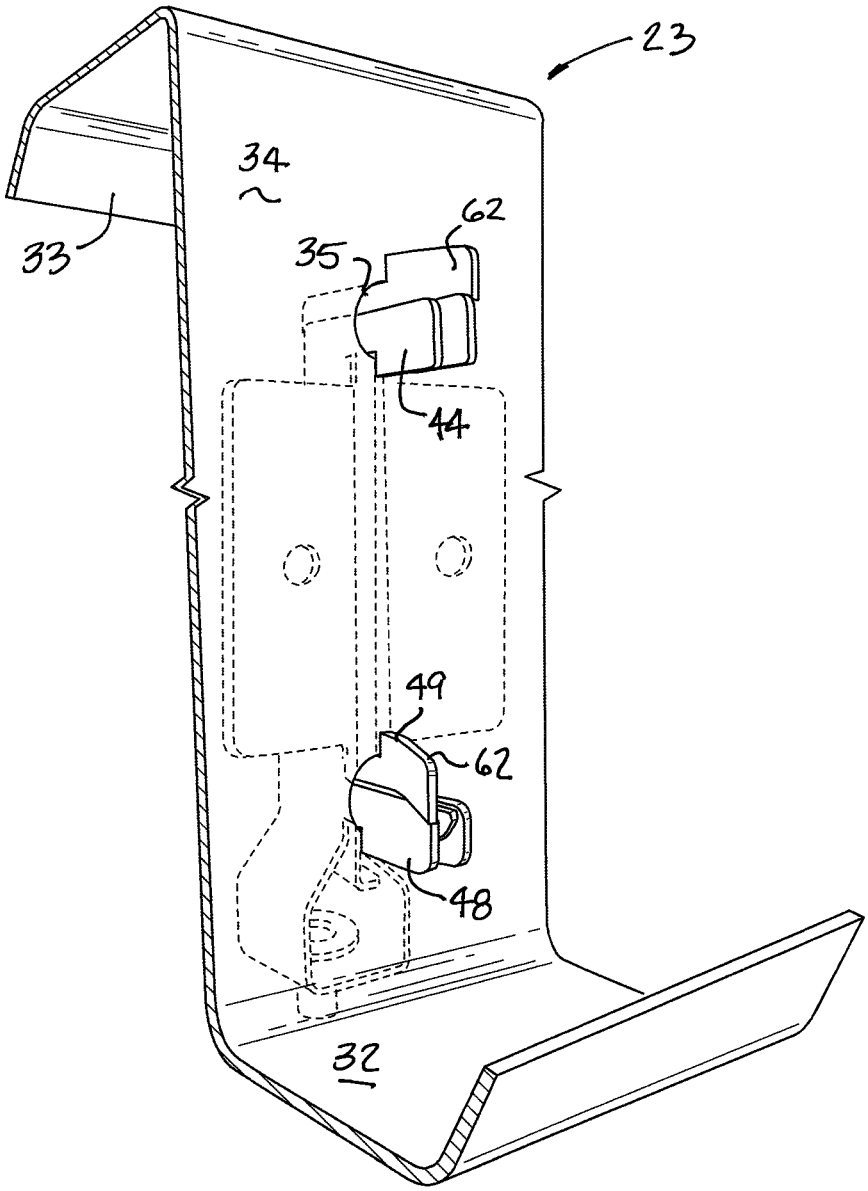
FIG. 19 is a respective perspective view of the second embodiment of the clip inserted into the web portion of the purlin.

FIGS. 18 and 19 are respective perspective or isometric views of the second embodiment of the clip 55 connected to a purlin 23 and in particular illustrating the use of the clip 55 with respect to the purlin 23 in a manner independent of any flange aperture (e.g. 36 in FIG. 7). Used in this manner, the clip 55 can still be attached to the purlin 23 using the span apertures 35 and 37. Independently of that connection, however, or alternatively combined with the span aperture connection, the second embodiment of the clip 55 can be fastened to the purlin 23 using one or both of the clip flanges 60, the clip flange holes 61 and an appropriate fastener illustrated as the metal screw 66.

Going further, however, the skilled person will understand that if desired or necessary, fastening the clip 55 using the clip flanges 60 offers the capability to attach to a purlin 23 that has no openings whatsoever other than any opening that would be created using (for example) the metal screw 66. In such use, the fingers (e.g., 44, 50) of the clip can be physically removed to allow the remainder of the clip 55 to fit flush or nearly flush against the purlin 23.

The clips 25 and 55 illustrated herein thus can provide significant flexibility in the construction and use of metal buildings. First, because the clips 25, 55 are independent of the purlin, they avoid adding additional manufacturing costs to the purlin itself. Second, because the clips 25, 55 are provided initially independently of the purlins 23, the clips 25, 55 can be located anywhere along the purlin as may be desired or necessary in the circumstances. Clips 25, 55 can be added by the user by having the user form (e.g., drill, cut) the necessary openings in the purlin 23, or purlins can be manufactured with the desired openings at regular or custom spacing. Such choices are economic in nature, rather than any limitation on the disclosure.

The combination of the clip 25, 55 combined with a perforated purlin 23 places all hanging weight on the web (the strongest part of the purlin) and none on the flanges 32, 33. Additionally, because the fastener 26 rests gently against the vapor barrier ceiling 27, the fastener 26 can be located easily by feel.

As another advantage, the fastener 26 on the clip 25, 55 provides the capacity to fix extra insulation in climates or for purposes where a high R-value is required, and where a metal building might otherwise be unacceptable. Exemplary foam board insulation can have a capacity of about R-4 or R-5 per inch (thickness) and glass wool is about R-3 or R-4 per inch. As a result, if (again, for example) R-60 is desired or necessary, 12-15 inches of foam board or 20 inches of glass wool could be required. Using the disclosure, such thicknesses can be easily suspended in the metal building context by selecting a hanger bolt 31 of a desired length. Additionally, a hanger bolt can terminate in its own fastener so that an appliance can still be supported, all using the strength of the purlin's 23 vertical span 34.

The clip is formed of two sliding parts so that when the sliding parts are completely nested, the clip can be easily added to a perforation in a purlin. The sliding parts can then be adjusted so that the notches 53, 54 engage the opposite sides (noon and 6 o'clock) of the perforation in the purlin. This locks the clip in place and positions the fastener both through the opening in the flange and extending slightly below the flange to touch the fabric barrier for ease of location later.

The clips are used rather than some permanent structure because minimizing weight is important and the use of clips makes the choice of the number of necessary clips in any installation completely optional for maximum design freedom. Because the (typically steel) purlins are manufactured, sold and transported all on the basis of weight, using the clips as an optional separate item adds value to the overall system.

Figure 20:
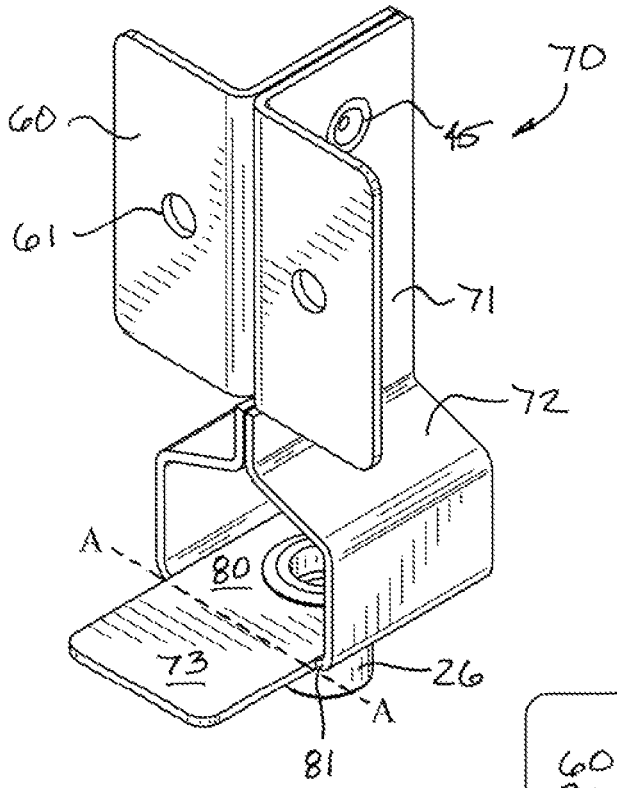
FIG. 20 is a perspective view of a third embodiment of the disclosure.
Figure 21:
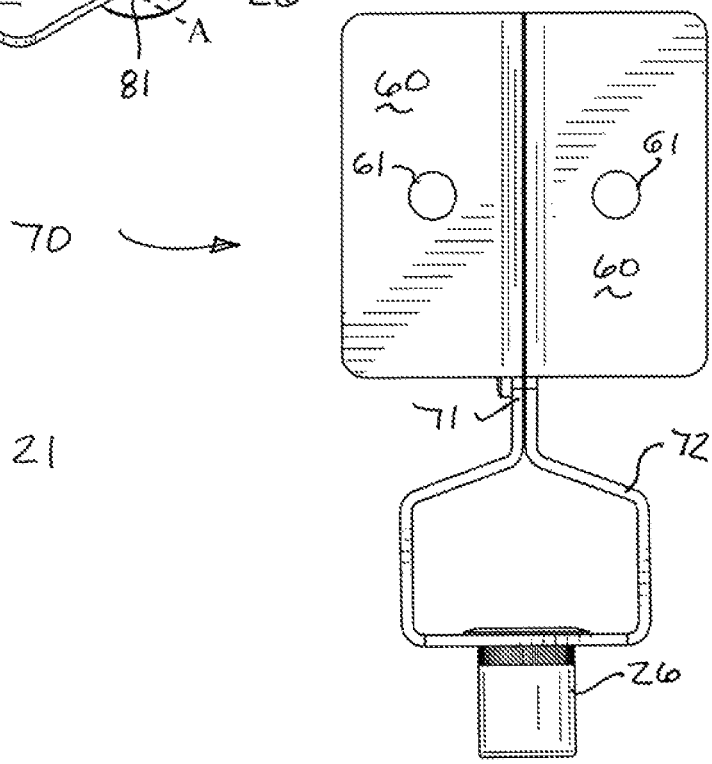
FIG. 21 is an elevational view of the third embodiment.
Figure 22:
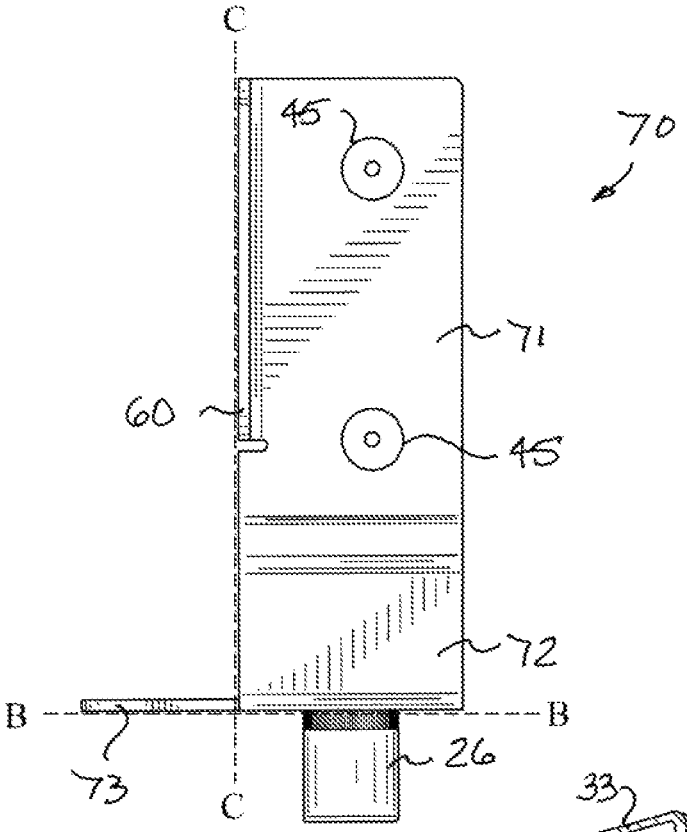
FIG. 22 is an elevational view of the third embodiment.

FIGS. 20, 21, 22, and 23 illustrate a third embodiment of the disclosure. Where possible, the same reference numerals are used to identify items common to the first two embodiments and the expected environment. FIG. 20 illustrates clip 70 oriented such that line A-A represents a Z axis and a terminal edge 81 of a bottom face 80. FIG. 22 further illustrates clip 70 oriented such that line B-B represents a X axis and line C-C represents a Y axis.

FIG. 20 is a perspective view of the clip 70, again for supporting weight from the roof of a metal building. The clip 70 includes the column 71 illustrated as a pair of flat panels fastened together by one or more rivets or clinches 45. The column 71 can also be a single piece, but the illustrated embodiment reflects to some extent one of the techniques by which such a clip can be formed. The clip 70 has a clip flange 60 (two are illustrated) on the column 71 and oriented perpendicularly to the column 71. The column 71 is fixed to a column base 72 generally analogous to the other embodiments. A fastener 26, with the purposes described previously, depends from the bottom of the column base 72.

In this embodiment, a base shelf 73 extends from the base 72 in a direction that is perpendicular to both the column 71 and the clip flanges 60.

The clip 70 can be formed of metal which in most cases supplies the necessary loadbearing strength to hang heavier objects from the ceiling. That said, the clip can be formed of other materials (e.g., engineering polymers; fabric reinforced materials, ceramics) depending upon the expected weight that the clip 70 will likely bear in particular circumstances.

FIG. 21 is a side elevational view of the clip 70 and illustrating the perpendicular relationship between the column 71 and the clip flanges 60.

FIG. 22 is another elevational view taken perpendicularly to FIG. 21 and showing the perpendicular relationship between the column 71 the base shelf 73. FIGS. 20 and 22 also illustrate the clip flange holes 61.

The clip 70 illustrated in FIG. 22 is oriented onto x and y coordinate axes. The column 71 is oriented on the x-y plane and extends along the x-axis from the y-z plane. The clip flange 60 is oriented on the y-z plane and extends perpendicularly from column 71 along the z-axis. The column base 72 extends from and below column 71 forming a bottom face 80 that is parallel to the x-z plane. The base shelf 73 is oriented on the x-z plane and extends from a terminal edge 81 of the bottom base 80.

Figure 23:
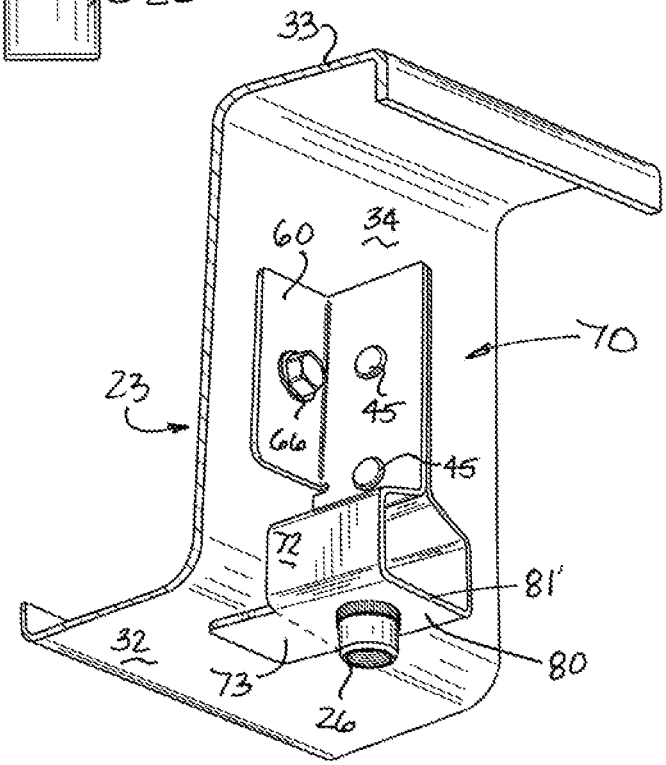
FIG. 23 is a perspective view of the third embodiment attached to the span of a purlin.

FIG. 23 is a perspective view of the clip 70 fastened to a purlin span 34 using a pair (only one is shown) of metal screws 66 to fasten the clip flange 60 to the purlin span 34. In this orientation, the purlin can be similar or identical to those illustrated in (for example) FIGS. 1 and 3. In FIG. 23, the clip flange 60 is fastened to the purlin span 34, and the base shelf 73 extends along and rests against the bottom flange 32 of the purlin to position the clip 70 against the purlin in a desired vertical position and to help prevent torsional forces from moving the clip 70 out of position. As FIGS. 20, 22 and 23 illustrate, in this embodiment the base 72 has five sides that outline a geometric solid (empty) with one face coplanar with the face of the clip flange 60 fixed against the purlin span 34.

Although not specifically illustrated in this embodiment, a fabric ceiling material 27 can be positioned under a plurality of purlins that they are against the fastener 26 so that the fabric flexes as it bears against the fastener or alternatively the fastener can be quickly located underneath the fabric even if the fabric isn't flexed.

As with the other embodiments, the hanger 31 can engage with the fastener 26 on the clip 70 and depend through and below any fabric ceiling material to support a weighted object on the hanger as may be desired or necessary.

Thus, a plurality of the illustrated embodiment of the clips 70 can be used in a manner similar to the other embodiments in a building that includes a plurality of vertical posts 21 and struts 22 in conjunction with the fabric ceiling 27 to permit items to be supported from the clips 70 and the purlins 23.

It will be understood that such a plurality of the clips 70, as with the other clip embodiments 25 and 55 can be installed in a customized pattern when the location of heavy objects is known. Alternatively, any of the clips 25, 55, and 70, can be placed in some other pattern from which they can be used on an as-selected basis.

As shown in FIG. 23 the third clip embodiment 70 can be placed on the opposite side of the purlin span 34 from the side on which the first clip embodiment is typically placed (e.g., FIG. 2).

In cases in which the column 71 is formed from two pieces (or a folded piece), these pieces can be held together with a rivet 45 (two are illustrated) or a clinch lock (i.e., drawing or forming the part materials into an interlock).

Figure 24:
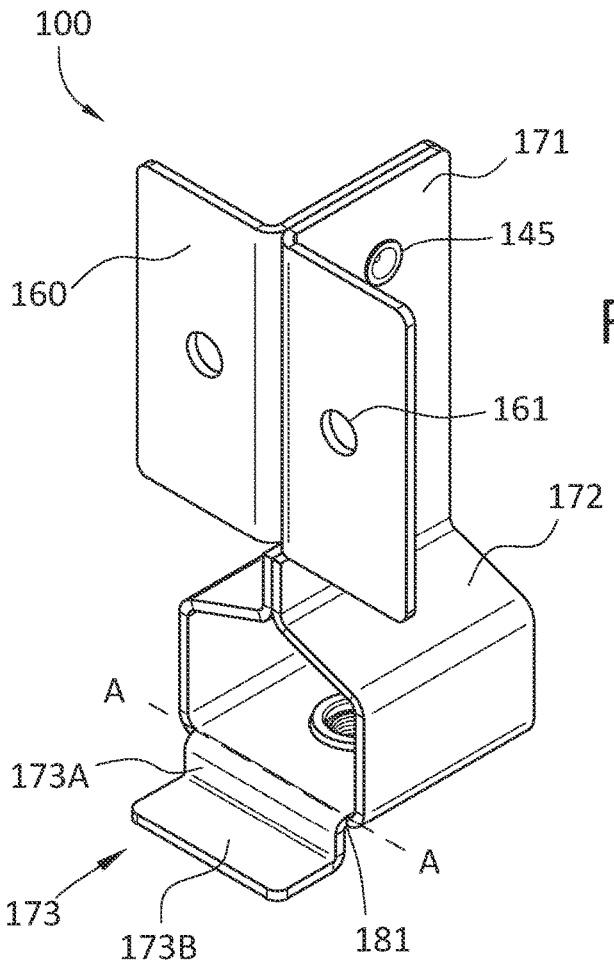
FIG. 24 is a perspective view of a fourth embodiment of the disclosure.
Figure 25:
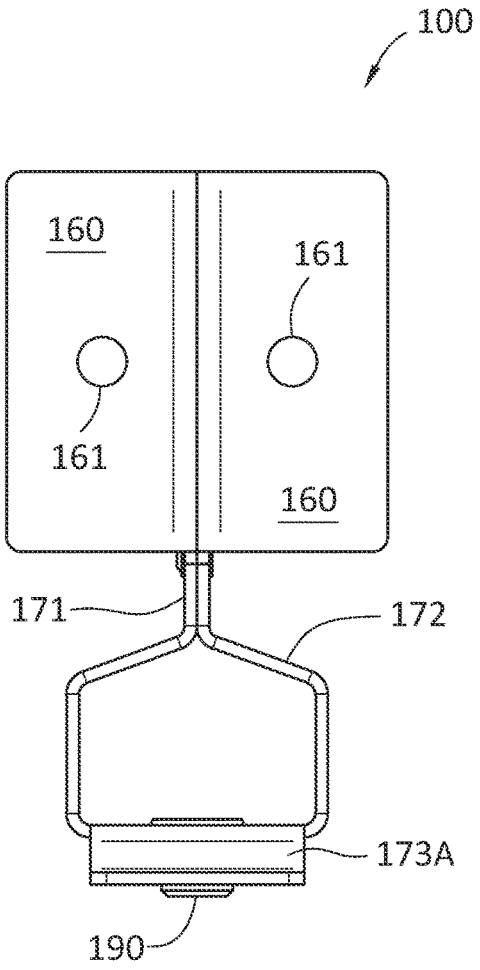
FIG. 25 is an elevational view of the fourth embodiment.
Figure 26:
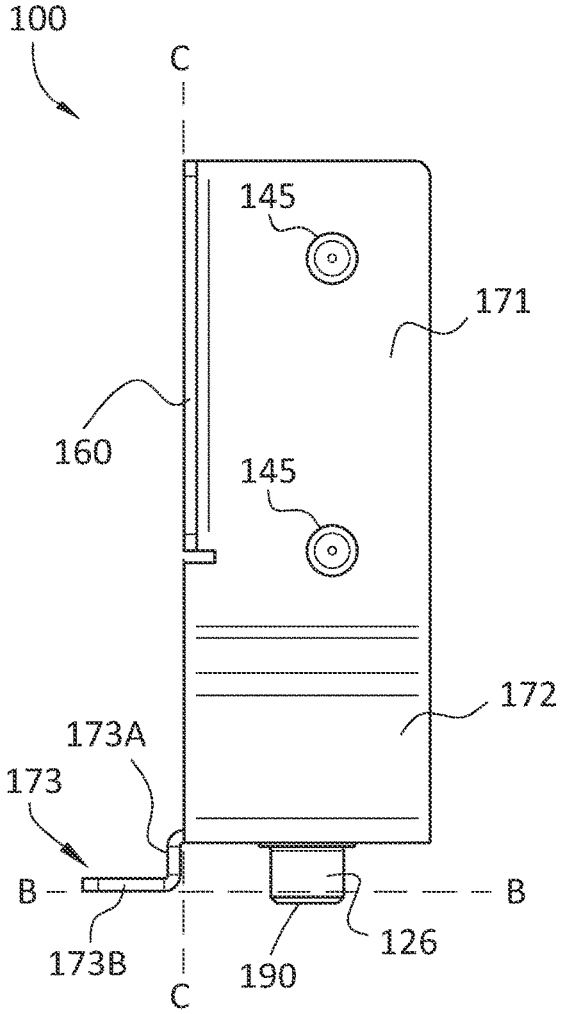
FIG. 26 is an elevational view of the fourth embodiment.

FIGS. 24, 25, 26, and 27 illustrate a fourth embodiment of the disclosure. FIG. 24 illustrates the clip 100 oriented such that line A-A represents a Z axis and a terminal edge 181 of a column base 172. FIG. 26 further illustrates clip 100 oriented such that line B-B represents an X axis and line C-C represents a Y axis.

Figure 27:
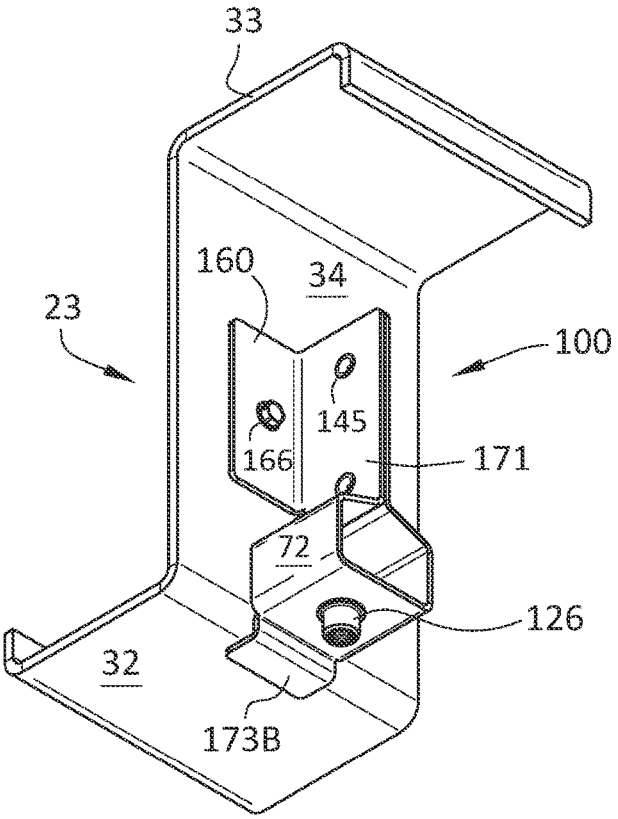
FIG. 27 is a perspective view of the fourth embodiment attached to the span of a purlin.

FIG. 24 is a perspective view of the clip 100, for use in supporting weight from the roof of a building. The clip 100 includes a column 171 illustrated as a pair of flat panels fastened together by one or more rivets or clinches 145. The column 171 can also be a single piece, but the illustrated embodiment reflects to some extent one of the techniques by which such a clip 100 can be formed. The clip 100 has a clip flange 160 (two are illustrated) on the column 171 and oriented approximately perpendicularly (+/−5°) to the column 171. As illustrated in FIG. 24, the clip flange may define a rectangular shape, but in other embodiments, the clip flange forms other geometric shapes such as a triangle, semicircle, or any other polygonal shape. Each clip flange 160 has a clip flange hole 161 which can be used as a method of fastening the clip flanges 160 to the span 34 of the purlin 23 as seen in FIG. 27. The column 171 is fixed to the column base 172 generally analogous to the other embodiments. A fastener 126, with the purposes described previously, depends from a bottom of the column base 172.

In this embodiment, a base shelf 173 extends from the base 172 in a stepped manner such that a first portion of the base shelf 173A extends downward (i.e., below) proximate a terminal edge 181 of the column base 172 and a second portion of the base shelf 173B extends approximately perpendicular (+/−5°) to clip flanges 160.

The clip 100 can be formed of metal which in most cases supplies the necessary loadbearing strength to hang heavier objects from the ceiling. That said, the clip 100 can be formed of other materials (e.g., engineering polymers; fabrics reinforced materials, ceramics) depending upon the expected weight that the clip 100 will likely bear in particular circumstances.

FIG. 25 is a side elevational view of the clip 100 and illustrating the approximately perpendicular (+/−5°) relationship between the column 171 and the clip flanges 160. FIG. 25 also illustrates the stepped nature of the base shelf 173, wherein the first portion of the base shelf 173A preferably extends downward (i.e., below) from proximate the terminal edge 181 of the column base 172 and not further than (i.e., below) the bottom end 190 of the fastener 126.

FIG. 26 is another elevational view taken perpendicularly to FIG. 25 and showing the approximately perpendicular (+/−5°) relationship between the column 171 and the second portion of the base shelf 173B. FIG. 25 and FIG. 26 also illustrate the second portion of the base shelf 173B situated slightly above the bottom end 190 of the fastener 126.

Clip 100 illustrated in FIG. 26 is oriented onto x and y coordinate axes. The column 171 is oriented on the x-y plane and extends along the x-axis from the y-z plane. The clip flange 160 is oriented on the y-z plane and extends from and approximately perpendicular (+/−5°) to column 171 along the z-axis. The column base 172 extends from and below column 171 forming a bottom that is parallel to the x-z plane. As illustrated in FIG. 26, the base shelf 173 may be configured such that the first portion of the base shelf 173A extends downward (i.e., below) from proximate the terminal edge 181 of the column base 172 and the second portion of the base shelf 173B extends along the X-axis (represented by line B-B) so that the bottom end 190 of the fastener 126 is located below the second portion of the base shelf 173B.

FIG. 27 is a perspective view of the clip 100 fastened to a purlin span 34 preferably using a pair (only one is shown) of metal screws 166 to fasten the clip flange 160 to the purlin span 34. In other embodiments the clip 100 may be fastened to the purlin span 34 using other types of mechanical fasteners such as, but not limited to, rivets, bolts, latches, pins, and nails. In this orientation, the purlin can be similar or identical to those illustrated in (for example) FIGS. 1 and 3. In FIG. 27, the clip flange 160 is fastened to the purlin span 34, and the second portion of the base shelf 173 extends along and rests against the bottom flange 32 of the purlin 23 to position the clip 100 against the purlin 23 in a desired vertical position and to help prevent torsional forces from moving the clip 100 out of position. As FIGS. 24, 25, 26, and 27 illustrate, in this embodiment the base 172 has five sides that outline a geometric solid (empty) with one face coplanar with the face of the clip flange 160 fixed against the purlin span 34. The clip flange 160 also has a face coplanar with a face of the first portion of the base shelf 173A.

Although not specifically illustrated in this embodiment, a fabric ceiling material 27 (FIG. 3) can be positioned under a plurality of purlins that they are against the fastener 126 so that the fabric flexes as it bears against the fastener or alternatively the fastener can be quickly located underneath the fabric even if the fabric isn't flexed. In this particular embodiment, the fastener 126 of clip 100 will tent the fabric ceiling material 27 less than the fastener 26 of clip 70.

As with the other embodiments, the hanger 31 can engage with the fastener 126 on the clip 100 and depend through and below any fabric ceiling material 27 to support a weighted object 24 (FIG. 1) on the hanger 31 (FIG. 2) as may be desired or necessary.

Thus, a plurality of the illustrated embodiment of the clips 100 can be used in a manner similar to the other embodiments in a building that includes a plurality of vertical posts 21 and struts 22 in conjunction with the fabric ceiling 27 to permit items to be supported from the clips 100 and the purlins 23.

It will be understood that such a plurality of the clips 100, as with the other clip embodiments 25, 55, and 70 can be installed in a customized pattern when the location of heavy objects is known. Alternatively, any of the clips 25, 55, 70, 100 can be placed in some other pattern from which they can be used on an as-selected basis.

As shown in FIG. 27 the fourth clip embodiment 100 can be placed on the opposite side of the purlin span 34 from the side on which the first clip 25 embodiment is typically placed (e.g., FIG. 2).

In cases in which the column 171 is formed from two pieces (or a folded piece), these pieces can be held together with a rivet 145 (two are illustrated) or a clinch lock (i.e., drawing or forming the part materials into an interlock).

Figure 28:
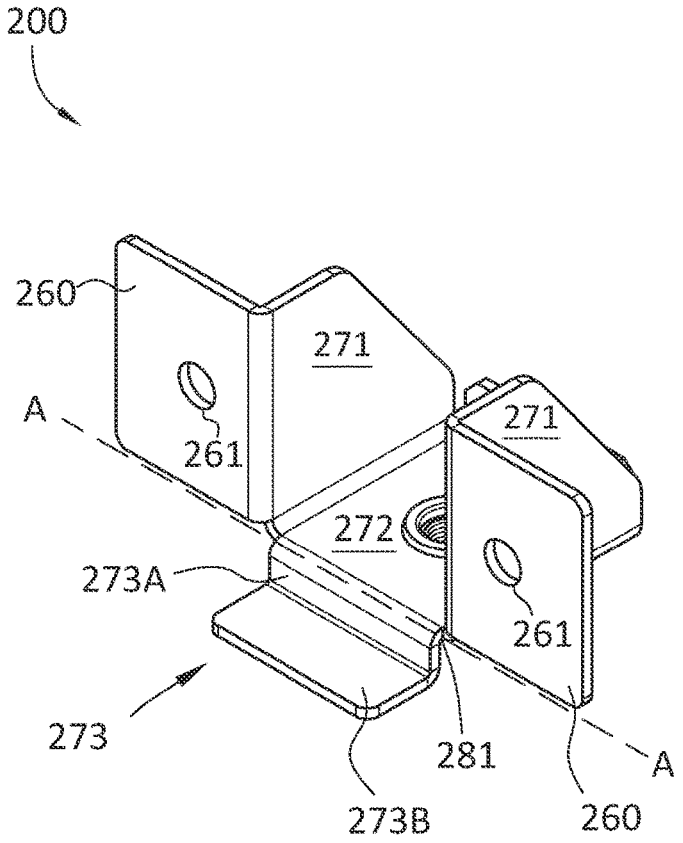
FIG. 28 is a perspective view of a fifth embodiment of the disclosure.
Figure 29:
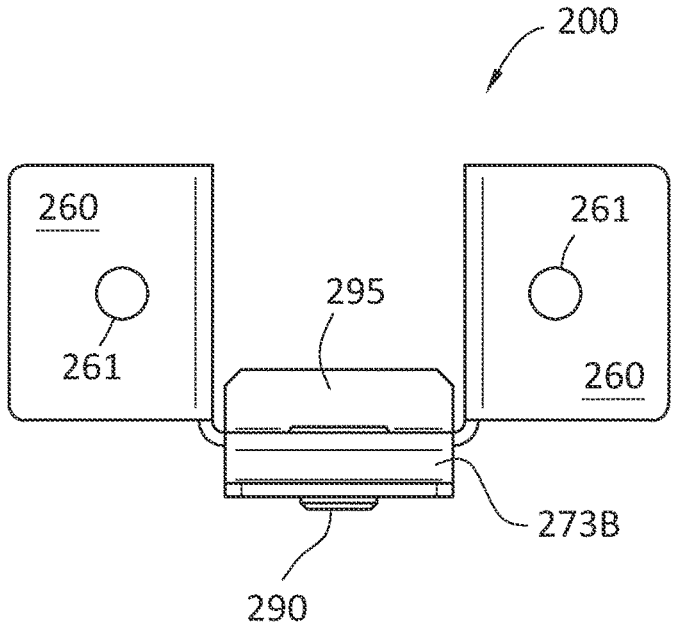
FIG. 29 is an elevational view of the fifth embodiment.
Figure 30:
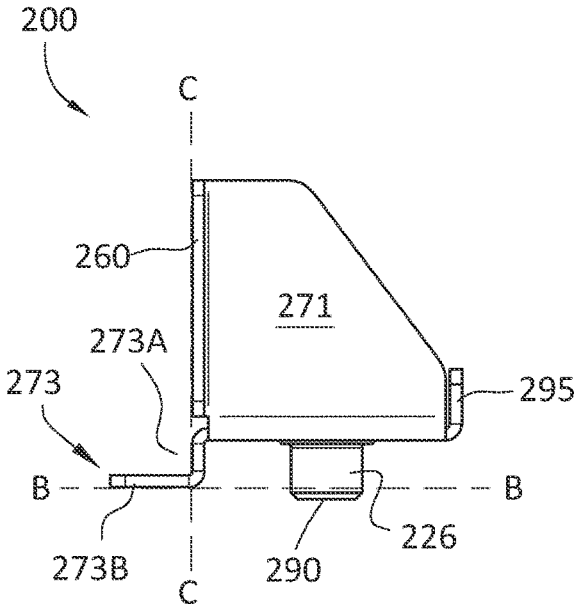
FIG. 30 is an elevational view of the fifth embodiment.

FIGS. 28, 29, 30, and 31 illustrate a fifth embodiment of the disclosure. FIG. 28 illustrates the clip 200 oriented such that line A-A represents a Z axis and a terminal edge 281 of a column base 272. FIG. 30 further illustrates clip 200 oriented such that line B-B represents an X axis and line C-C represents a Y axis.

FIG. 28 is a perspective view of the clip 200, for use in supporting weight from the roof of a metal building. The clip 200 includes two columns 271 illustrated as a pair of flat panels extending upward (i.e., vertically) from the column base 272. This illustrated embodiment reflects to some extent another of the techniques by which such a clip can be formed. The clip 200 has a clip flange 260 (two are illustrated) on each of the two columns 271 and are oriented approximately perpendicular (+/−5°) to the column 271. As illustrated in FIG. 28, the clip flange may define a rectangular shape, but in other embodiments, the clip flange forms other geometric shapes such as a triangle, semicircle, or any other polygonal shape. Each clip flange 260 has a clip flange hole 261 which can be used as a method of fastening the clip flanges 260 to the span 34 of the purlin 23. The columns 271 are formed from opposite edges of the column base 272. A fastener 226, with the purposes described previously, depends from the column base 272.

In this embodiment, a base shelf 273 extends from the base 272 in a stepped manner such that a first portion of the base shelf 273A extends downward (i.e., below) proximate a terminal edge 281 of the column base 272 and a second portion of the base shelf 273B extends approximately perpendicular (+/−5°) to clip flanges 260.

The clip 200 can be formed of metal which in most cases supplies the necessary loadbearing strength to hang heavier objects from the ceiling. That said, the clip can be formed of other materials (e.g., engineering polymers; fabrics reinforced materials, ceramics) depending upon the expected weight that the clip 200 will likely bear in particular circumstances.

FIG. 29 is a side elevational view of the clip 200 and illustrating the approximately perpendicular (+/−5°) relationship between the two columns 271 and the clip flanges 260. FIG. 29 also illustrates the stepped nature of the base shelf 273, wherein the first portion of the base shelf 273A preferably extends downward (i.e., below) from proximate the terminal edge 281 of the column base 272 and not further than (i.e., below) the bottom end 290 of the fastener 226. FIG. 29 further illustrates a base flange 295 extending upward (i.e., vertically) from proximate a second terminal edge 281' that is opposite the terminal edge 281. In some embodiments (not shown), the base flange 295 may be formed together with the two columns 271, but as shown in FIG. 29, the base flange 295 may be disconnected with each of the columns 271. The base flange 295 provides an increased structural rigidity to the column base 272.

FIG. 30 is another elevational view taken perpendicularly to FIG. 29 and showing the approximately perpendicular (+/−5°) relationship between the two columns 271 and the second portion of the base shelf 273B. FIGS. 29 and 30 also illustrate the second portion of the base shelf 273B may be situated slightly above the bottom end 290 of the fastener 226. The first portion of the base shelf 273A includes a face approximately coplanar with the face of the clip flanges 260.

Clip 200 illustrated in FIG. 30 is oriented onto x and y coordinate axes. The columns 271 are oriented on the x-y plane and extend along the x-axis from the y-z plane. The clip flanges 260 are oriented on the y-z plane and extend from and approximately perpendicular (+/−5°) to each column 271 along the z-axis. The column base 272 extends from and below the columns 271 forming a bottom face 280 that is parallel to the x-z plane. As illustrated in FIG. 30, the base shelf 273 may be configured such that the first portion of the base shelf 273A extends downward (i.e., below) from proximate the terminal edge 281 of the column base 272 and the second portion of the base shelf 273B extends along the X-axis (represented by line B-B) so that the bottom end 290 of the fastener 226 is located below the second portion of the base shelf 273B. The base flange 295 extends upward (i.e., vertically) from proximate the second terminal edge 281' that is opposite the terminal edge 281.

Figure 31:
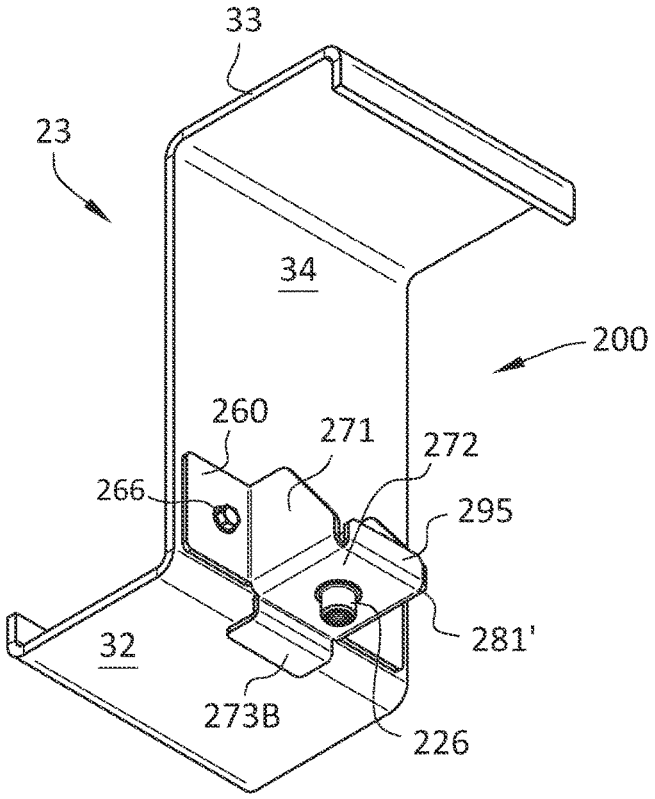
FIG. 31 is a perspective view of the fifth embodiment attached to the span of a purlin.

FIG. 31 is a perspective view of the clip 200 fastened to a purlin span 34 using a pair (only one is shown) of metal screws 266 to fasten each clip flange 260 to the purlin span 34. In other embodiments the clip 200 may be fastened to the purlin span 34 using other types of mechanical fasteners such as, but not limited to, rivets, bolts, latches, pins, and nails. In this orientation, the purlin can be similar or identical to those illustrated in (for example) FIGS. 1 and 3. In FIG. 31, the clip flanges 260 are fastened to the purlin span 34, and the second portion of the base shelf 273B extends along and rests against the bottom flange 32 of the purlin 23 to position the clip 200 against the purlin 23 in a desired vertical position and to help prevent torsional forces from moving the clip 200 out of position. As FIGS. 28, 29, 30, and 31 illustrate, in this embodiment the two columns 271 extend upward (i.e., vertically) from opposite edges of the base 272 such that the two columns 271 are approximately perpendicular (+/−5°) to the bottom of the base 272. The clip flange 260 also has a face coplanar with a face of the first portion of the base shelf 273A.

Although not specifically illustrated in this embodiment, a fabric ceiling material 27 (FIG. 3) can be positioned under a plurality of purlins that they are against the fastener 226 so that the fabric flexes as it bears against the fastener or alternatively the fastener can be quickly located underneath the fabric even if the fabric isn't flexed. In this particular embodiment, the fastener 226 of clip 200 will tent the fabric ceiling material 27 similar to the fastener 126 of clip 100.

As with the other embodiments, the hanger 31 (FIG. 2) can engage with the fastener 226 on the clip 200 and depend through and below any fabric ceiling material 27 to support a weighted object 24 (FIG. 1) on the hanger 31 as may be desired or necessary.

Thus, a plurality of the illustrated embodiment of the clips 200 can be used in a manner similar to the other embodiments in a building that includes a plurality of vertical posts 21 and struts 22 in conjunction with the fabric ceiling 27 to permit items to be supported from the clips 200 and the purlins 23.

It will be understood that such a plurality of the clips 200, as with the other clip embodiments 25, 55, 70, and 100 can be installed in a customized pattern when the location of heavy objects is known. Alternatively, any of the clips 25, 55, 70, 100, and 200 can be placed in some other pattern from which they can be used on an as-selected basis.

As shown in FIG. 31 the fifth clip embodiment 200 can be placed on the opposite side of the purlin span 34 from the side on which the first clip 25 embodiment is typically placed (e.g., FIG. 2).

Figure 32:
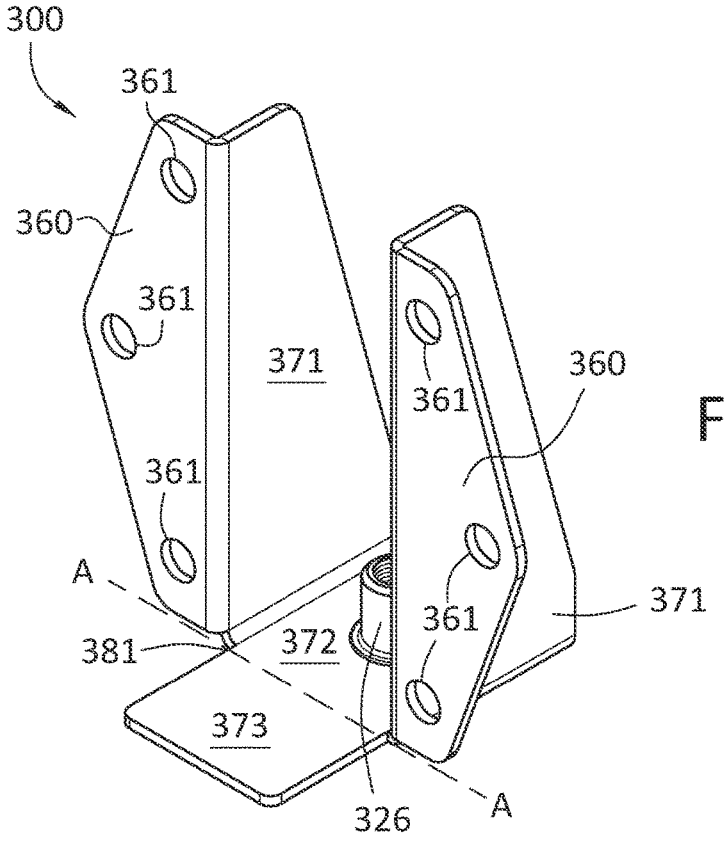
FIG. 32 is a perspective view of a sixth embodiment of the disclosure.
Figure 33:
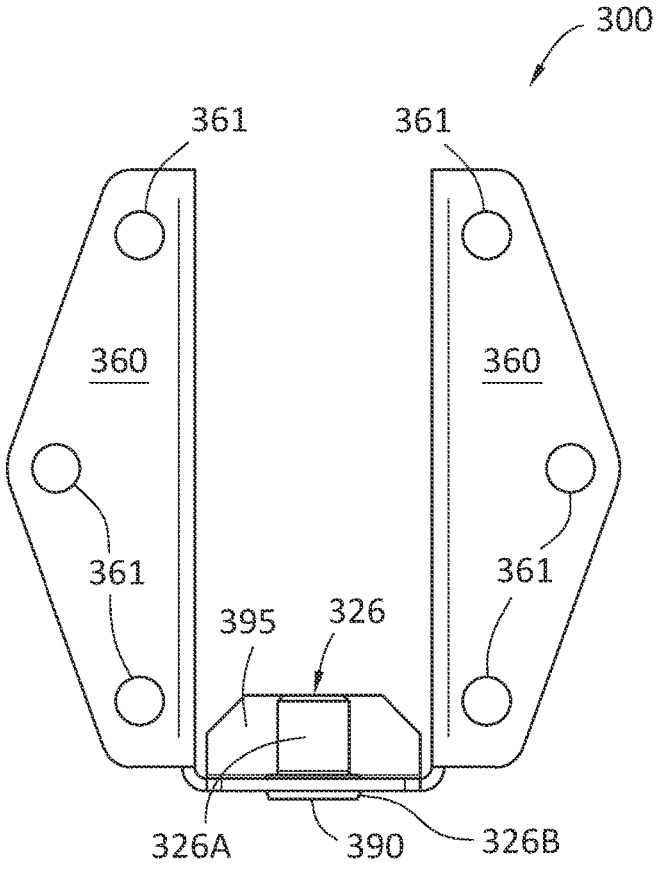
FIG. 33 is an elevational view of the sixth embodiment.
Figure 34:
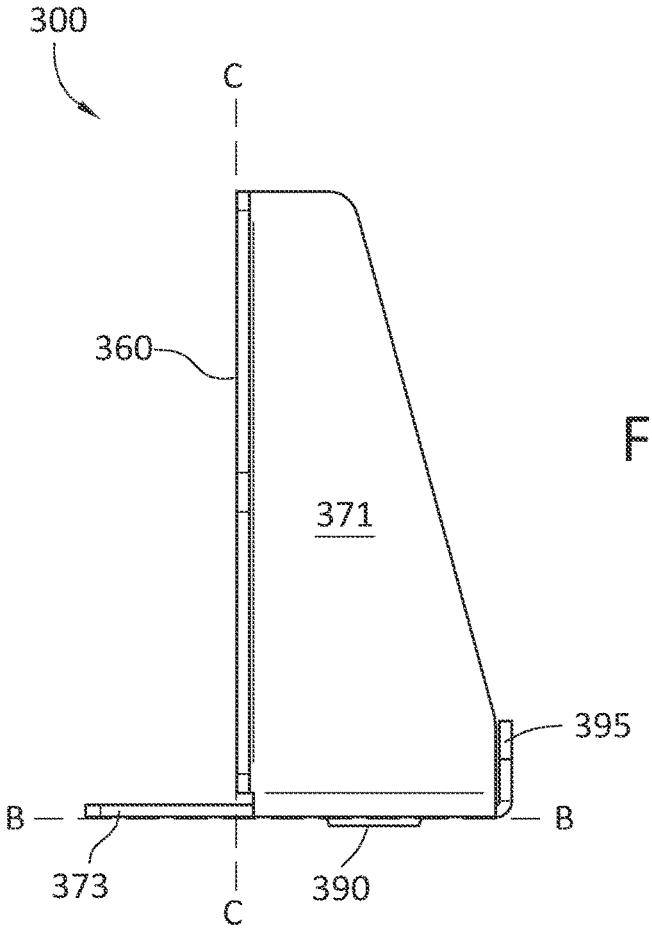
FIG. 34 is an elevational view of the sixth embodiment.

FIGS. 32, 33, 34, and 35 illustrate a sixth embodiment of the disclosure. FIG. 32 illustrates the clip 300 oriented such that line A-A represents a Z axis and a terminal edge 381 of a column base 372. FIG. 34 further illustrates clip 300 oriented such that line B-B represents an X axis and line C-C represents a Y axis.

FIG. 32 is a perspective view of the clip 300, for use in supporting weight from the roof of a metal building. The clip 300 includes two columns 371 illustrated as a pair of flat panels extending upward (i.e., vertically) from the column base 372. This illustrated embodiment reflects to some extent another of the techniques by which such a clip can be formed, similar to the technique used to form clip 200. The clip 300 has a clip flange 360 (two are illustrated) on each of the columns 371 and are oriented approximately perpendicular (+/−5°) to each column 371. As illustrated in FIG. 32, the clip flange may define a polygonal shape, but in other embodiments, the clip flange forms other geometric shapes such as a rectangle and a semicircle. Each clip flange 360 has a clip flange hole 361 which can be used as a method of fastening the clip flanges 360 to the span 34 of the purlin 23. The columns 371 are fixed to opposite edges of the column base 372. A fastener 326, with the purposes described previously, extending from the column base 372 such that a major portion 326A of the fastener 326 extends above the column base 372 and a minor portion 326B of the fastener 326 contiguous bottom end 390 extends below the column base 372.

In this embodiment, a base shelf 373 is not stepped like the base shelves 173, 273 of clips 100, 200, respectively, instead, the base shelf 373 extends from a terminal edge 381 of the base 372 in a direction that is approximately perpendicular (+/−5°) to both the column 371 and the clip flanges 360.

The clip 300 can be formed of metal which in most cases supplies the necessary loadbearing strength to hang heavier objects from the ceiling. That said, the clip 300 can be formed of other materials (e.g., engineering polymers; fabrics reinforced materials, ceramics) depending upon the expected weight that the clip 300 will likely bear in particular circumstances.

Figure 35:
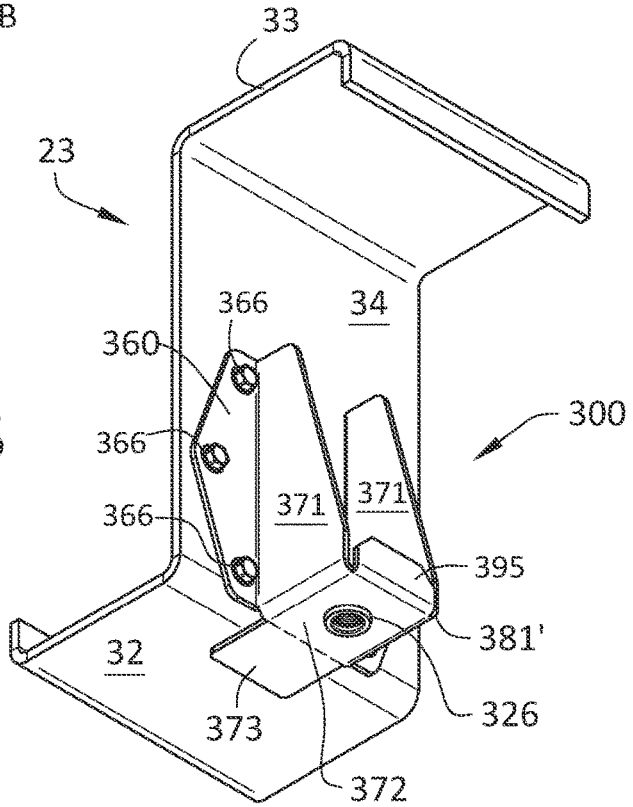
FIG. 35 is a perspective view of the sixth embodiment attached to the span of a purlin.

FIG. 33 is a side elevational view of the clip 300 and illustrating the approximately perpendicular (+/−5°) relationship between the two columns 371 and the clip flanges 360. FIG. 33 further illustrates a base flange 395 extending upward (i.e., vertically) from proximate a second terminal edge 381' that is opposite the terminal edge 381. In some embodiments (not shown), the base flange 395 may be formed together with the two columns 371, but as shown in FIG. 35, the base flange 395 may be disconnected with each of the columns 371. The base flange 395 provides an increased structural rigidity to the column base 372.

FIG. 34 is another elevational view taken perpendicularly to FIG. 33 and showing the approximately perpendicular (+/−5°) relationship between the two columns 371 and the base shelf 373. FIG. 33 and FIG. 34 also illustrate the base shelf 373 situated slightly above the bottom end 390 of the fastener 326 and coplanar (i.e., parallel) with the column base 372.

Clip 300 illustrated in FIG. 34 is oriented onto x and y coordinate axes. The columns 371 are oriented on the x-y plane and extend along the x-axis from the y-z plane. The clip flanges 360 are oriented on the y-z plane and extends from and approximately perpendicular (+/−5°) from each column 371 along the z-axis. The column base 372 extends from and below the columns 371 forming a bottom face 380 that is parallel to the x-z plane. As illustrated in FIG. 34, the base shelf extends from the terminal edge 381 along the X-axis (represented by line B-B) so that the bottom end 390 of the fastener 326 is located below the base shelf 373. The base flange 395 extends upward (i.e., vertically) from proximate the second terminal edge 381' that is opposite the terminal edge 281.

FIG. 35 is a perspective view of the clip 300 fastened to a purlin span 34 using six (only three are shown) metal screws 366 to fasten each clip flange 360 to the purlin span 34. In other embodiments the clip 300 may be fastened to the purlin span 34 using other types of mechanical fasteners such as, but not limited to, rivets, bolts, latches, pins, and nails. In this orientation, the purlin 23 can be similar or identical to those illustrated in (for example) FIGS. 1 and 3. In FIG. 35, the clip flanges 360 are fastened to the purlin span 34, and the base shelf 373 extends along and rests against the bottom flange 32 of the purlin 23 to position the clip 300 against the purlin 23 in a desired vertical position and to help prevent torsional forces from moving the clip 300 out of position. As FIGS. 32, 33, 34, and 35 illustrate, in this embodiment the two columns 371 extend upwardly (i.e., vertically) from opposite edges of the base 372 such that the two columns 371 are approximately perpendicular (+/−5°) to the base 372.

Although not specifically illustrated in this embodiment, a fabric ceiling material 27 (FIG. 3) can be positioned under a plurality of purlins 23 that they are against the fastener 326 so that the fabric flexes as it bears against the fastener or alternatively the fastener can be quickly located underneath the fabric even if the fabric isn't flexed. In this particular embodiment, the fastener 326 of clip 300 will tent the fabric ceiling material 27 in a manner similar to the fasteners 126, 226 of clips 100, 200 respectively.

As with the other embodiments, the hanger 31 (FIG. 2) can engage with the fastener 326 on the clip 300 and depend through and below any fabric ceiling material 27 to support a weighted object 24 (FIG. 1) on the hanger 31 as may be desired or necessary.

Thus, a plurality of the illustrated embodiment of the clips 300 can be used in a manner similar to the other embodiments in a building that includes a plurality of vertical posts 21 and struts 22 (FIG. 1) in conjunction with the fabric ceiling 27 to permit items to be supported from the clips 300 and the purlins 23.

It will be understood that such a plurality of the clips 300, as with the other clip embodiments 25, 55, 70, 100, and 200 can be installed in a customized pattern when the location of heavy objects is known. Alternatively, any of the clips 25, 55, 70, 100, 200, and 300 can be placed in some other pattern from which they can be used on an as-selected basis.

As shown in FIG. 35 the sixth clip embodiment 300 can be placed on the opposite side of the purlin span 34 from the side on which the first clip 25 embodiment is typically placed (e.g., FIG. 2).

In the drawings and specification there has been set forth a preferred embodiment of the disclosure, and although specific terms have been employed, they are used in a generic and descriptive sense only and not for purposes of limitation, the scope of the disclosure being defined in the claims.

I claim:

1. A clip for supporting weight from the roof of a building, said clip comprising:

a first column;

a first clip flange extending from an edge of the first column;

a column base depending from and extending below the first column;

a fastener depending from the column base; and a base shelf extending from a terminal edge of the column base, wherein the base shelf includes a first shelf portion defined along a first plane and extending below the column base in a first direction and a second shelf portion defined along a second plane and extending in a second direction in relation to the first clip flange, and wherein the first plane and the second plane are substantially perpendicular.

2. The clip of claim 1 comprising a second column extending from an opposing lateral edge of the column base in relation to the first column.

3. The clip of claim 2 comprising a second clip flange, wherein the first clip flange extends from and approximately perpendicular to the first column and the second clip flange extends from and approximately perpendicular to the second column.

4. The clip of claim 3 wherein the first clip flange and the second clip flange both define at least one aperture for receiving a mechanical fastener to attach the clip to a purlin.

5. The clip of claim 1 further comprising a base flange extending from an opposing edge opposite the terminal edge of the column base.

6. The clip of claim 1 wherein the second shelf portion of the base shelf extends approximately perpendicular to the first clip flange.

7. The clip of claim 1 wherein the first clip flange defines a polygonal shape.

8. The clip of claim 1 further comprising a purlin wherein the clip is mechanically fastened to the purlin.

9. The clip of claim 1 wherein a bottom end of the fastener is situated below the second shelf portion of the base shelf.

10. A clip for supporting weight from the roof of a building, said clip comprising:

a first column;

a first clip flange extending from an edge of the first column;

a column base depending from and extending below the first column;

a fastener extending from the column base, wherein a major portion of the fastener extends above the column base, and a minor portion extends below the column base; and a base shelf extending from a terminal edge of the column base, wherein the base shelf includes a first shelf portion defined along a first plane and extending below the column base in a first direction and a second shelf portion defined along a second plane and extending in a second direction in relation to the first clip flange, and wherein the first plane and second plane are substantially perpendicular.

11. The clip of claim 10 comprising a second column extending from an opposing lateral edge of the column base in relation to the first column.

12. The clip of claim 11 comprising a second clip flange, wherein the first clip flange extends from and approximately perpendicular to the first column and the second clip flange extends from and approximately perpendicular to the second column.

13. The clip of claim 12 wherein the first clip flange and the second clip flange both define at least one aperture for receiving a mechanical fastener to attach the clip to a purlin.

14. The clip of claim 10 further comprising a base flange extending from an opposing edge opposite the terminal edge of the column base.

15. The clip of claim 10 wherein the base shelf extends approximately perpendicular to the first clip flange.

16. The clip of claim 10 wherein the first clip flange defines a polygonal shape.

17. The clip of claim 10 further comprising a purlin wherein the clip is mechanically fastened to the purlin.

18. The clip of claim 10 wherein a bottom end of the fastener is situated below the base shelf.

19. A clip for supporting weight from the roof of a building, said clip comprising:

a first column;

a first clip flange extending from an edge of the first column;

a column base depending from and extending below the first column;

a fastener extending from the column base;

a base shelf extending from a terminal edge of the column base, wherein the base shelf includes a first shelf portion defined along a first plane and extending below the column base in a first direction and a second shelf portion defined along a second plane and extending in a second direction in relation to the first clip flange, and wherein the first plane and second plane are substantially perpendicular; and a base flange extending from an opposing edge in relation to the terminal edge of the column base.

20. The clip of claim 19, comprising a second column, wherein the first column and second column extend from and are perpendicular to opposite lateral edges of the column base, wherein the first column includes a first clip flange extending from and perpendicular to the first column and the second column includes a second clip flange extending from and perpendicular to the second column, and wherein the first clip flange and the second clip flange each define at least one aperture for receiving a mechanical fastener to attach the clip to a purlin.

* * * * *